US008584845B2

(12) United States Patent
Soltis, Jr.

(10) Patent No.: US 8,584,845 B2
(45) Date of Patent: Nov. 19, 2013

(54) APPARATUS AND METHOD FOR STORING A WATCH

(76) Inventor: Ronald S. Soltis, Jr., North Ridgeville, OH (US)

( * ) Notice: Subject to any disclaimer, the term of this patent is extended or adjusted under 35 U.S.C. 154(b) by 239 days.

(21) Appl. No.: 13/091,731

(22) Filed: Apr. 21, 2011

(65) Prior Publication Data

US 2011/0260589 A1 Oct. 27, 2011

Related U.S. Application Data

(60) Provisional application No. 61/327,345, filed on Apr. 23, 2010.

(51) Int. Cl.
*B65D 85/40* (2006.01)

(52) U.S. Cl.
USPC ..... 206/301; 53/396; 206/18

(58) Field of Classification Search
USPC ..... 206/18, 6.1, 301, 566, 806; 29/428; 53/396, 467; 211/1.51–1.55, 85.2; 248/114–116; 368/206, 316
See application file for complete search history.

(56) References Cited

U.S. PATENT DOCUMENTS

| | | | |
|---|---|---|---|
| 2,147,343 | A | 2/1939 | Hokanson |
| 2,313,883 | A | 3/1943 | Lowther |
| 2,353,851 | A | 7/1944 | Rosan |
| 2,366,459 | A | 1/1945 | Rosa |
| 2,373,083 | A | 4/1945 | Brewster |
| 2,511,105 | A | 6/1950 | Fenyvessy |
| 2,747,787 | A | 5/1956 | Davidson, Jr. |
| 2,779,228 | A | 1/1957 | Meepos et al. |
| 2,863,345 | A | 12/1958 | Fiechter |
| 2,901,804 | A | 9/1959 | Williams |
| 2,926,519 | A | 3/1960 | Setterberg |
| 2,968,205 | A | 1/1961 | Springate |
| 2,983,978 | A | 5/1961 | Wilgus |
| 3,037,256 | A | 6/1962 | Chapman |
| 3,046,629 | A | 7/1962 | Malesko |
| 3,052,940 | A | 9/1962 | Sellers |
| 3,068,737 | A | 12/1962 | Mewse |
| 3,085,462 | A | 4/1963 | Myers |
| 3,117,484 | A | 1/1964 | Myers |
| 3,129,472 | A | 4/1964 | Hensel |
| 3,145,441 | A | 8/1964 | Strandrud |
| 3,180,390 | A | 4/1965 | Ockert, Jr. |
| 3,215,023 | A | 11/1965 | Becker |
| 3,233,496 | A | 2/1966 | De Pew et al. |
| 3,243,837 | A | 4/1966 | Smith |
| 3,276,799 | A | 10/1966 | Moore et al. |
| 3,277,767 | A | 10/1966 | Allen et al. |

(Continued)

FOREIGN PATENT DOCUMENTS

GB 957177 5/1964

*Primary Examiner* — Luan K Bui
(74) *Attorney, Agent, or Firm* — Brouse McDowell; Heather M. Barnes; Barry Winkler

(57) ABSTRACT

Provided is a watch storage apparatus comprising a base and a first watch engagement mechanism. The base may comprise a first surface and a receiver engaged with the first surface. The receiver may comprise a first hole. The first watch engagement mechanism may comprise a pin and a retaining band engaged with the pin. The pin may be selectably engagable with the first hole. The retaining band may define a structure having a perimeter to which an associated watch may be selectively removably and securely engaged about the perimeter so as to prevent slippage of the watch band relative to the perimeter of the structure.

15 Claims, 34 Drawing Sheets

(56) References Cited

U.S. PATENT DOCUMENTS

| | | | | | |
|---|---|---|---|---|---|
| 3,596,554 | A | | 8/1971 | Low et al. | |
| 3,670,437 | A | | 6/1972 | Brien | |
| 3,891,182 | A | | 6/1975 | Schwerin | |
| 4,011,942 | A | | 3/1977 | Crosslen | |
| 4,034,849 | A | | 7/1977 | Zakrajsek | |
| 4,057,958 | A | * | 11/1977 | Wuntch | 368/207 |
| 4,082,183 | A | | 4/1978 | Sturm | |
| 4,085,763 | A | | 4/1978 | Thomas | |
| 4,094,409 | A | | 6/1978 | Spranger et al. | |
| 4,185,474 | A | | 1/1980 | Kulischenko | |
| 4,216,858 | A | * | 8/1980 | Beauchamp | 206/301 |
| 4,420,084 | A | | 12/1983 | Whelan | |
| 4,433,854 | A | | 2/1984 | Smith | |
| 4,799,588 | A | * | 1/1989 | Trisl | 206/301 |
| 4,913,610 | A | | 4/1990 | Olivieri | |
| 4,988,248 | A | | 1/1991 | Flux | |
| 5,027,624 | A | | 7/1991 | Agbay et al. | |
| 5,136,557 | A | * | 8/1992 | Plawker et al. | 248/116 |
| 5,207,544 | A | | 5/1993 | Yamamoto et al. | |
| 5,340,255 | A | | 8/1994 | Duran | |
| 5,383,552 | A | | 1/1995 | Dikowitz | |
| 5,394,594 | A | | 3/1995 | Duran | |
| 5,494,323 | A | | 2/1996 | Huang | |
| D379,064 | S | | 5/1997 | Lee | |
| 5,682,987 | A | | 11/1997 | Herzog | |
| 5,741,022 | A | | 4/1998 | Wass et al. | |
| 5,799,911 | A | * | 9/1998 | Dostie et al. | 248/116 |
| 5,810,165 | A | * | 9/1998 | Lai | 206/301 |
| D409,416 | S | | 5/1999 | Au | |
| 6,264,148 | B1 | * | 7/2001 | Chandler | 248/116 |
| 6,341,751 | B1 | | 1/2002 | Herzog | |
| 6,386,789 | B1 | | 5/2002 | Chausse et al. | |
| D470,766 | S | | 2/2003 | Fai Au | |
| 6,543,929 | B1 | | 4/2003 | Agnoff | |
| 6,595,713 | B1 | | 7/2003 | Wilson | |
| 6,629,677 | B2 | * | 10/2003 | Kirshner | 248/116 |
| 6,722,711 | B2 | | 4/2004 | Kitzis | |
| 6,769,653 | B2 | | 8/2004 | Au et al. | |
| 6,786,669 | B2 | | 9/2004 | Tsui et al. | |
| D497,805 | S | | 11/2004 | Gratiot | |
| 6,884,013 | B2 | | 4/2005 | Kiviranta et al. | |
| 6,910,802 | B2 | | 6/2005 | Rustioni | |
| 6,939,034 | B2 | | 9/2005 | Dubois | |
| 6,964,513 | B1 | | 11/2005 | Agnoff | |
| 7,198,401 | B2 | | 4/2007 | Louie | |
| 7,574,768 | B2 | | 8/2009 | Morris et al. | |
| 7,575,367 | B2 | | 8/2009 | Wolf et al. | |
| 7,891,903 | B2 | | 2/2011 | Klingenberg et al. | |
| 2002/0092781 | A1 | | 7/2002 | Au et al. | |
| 2005/0265129 | A1 | | 12/2005 | Agnoff | |
| 2007/0003391 | A1 | | 1/2007 | Stapulionis et al. | |
| 2007/0177465 | A1 | | 8/2007 | Rossi | |
| 2008/0056814 | A1 | | 3/2008 | Klingenberg et al. | |

* cited by examiner $$r = 8 + 6\sin(\theta)$$

APPARATUS AND METHOD FOR STORING A WATCH

This utility application claims priority from a provisional patent application having Ser. No. 61/327,345 filed on Apr. 23, 2010.

TECHNICAL FIELD

The present invention disclosed herein relates generally to an apparatus and method for storing wrist watches. Certain embodiments disclosed herein relate to an apparatus and method for storing, securing, display, maintenance, protection, housing, and/or holding of watches.

BACKGROUND

Watches come in a wide variety of forms and span a very large scope of the technical arts, the jewelers' arts, and artistic expression generally. Watches are often sources of pride for collectors. Watches, like other collections may be desired to be clearly stored, secured, housed, held, protected or displayed, while still being protected and/or still being accessible for inspection or maintenance. Further, watches that are displayed or stored are typically supported by a pillow. Problems with storage devices utilizing pillows include the inability to store watched in a vertical or inclined position, and over time if not immediately, the weight of the stored watch pulls pillows out of placement.

It remains desirable to provide an apparatus and method adapted to store, secure, houses, hold, protect or display a watch without the use of a pillow. It remains desirable to provide an apparatus and method adapted to store, secure, houses, hold, protect or display a watch and allow ease of access for inspection or maintenance.

SUMMARY

Provided is a watch storage apparatus comprising a base and a first watch engagement mechanism. The base may comprise a first surface and a receiver engaged with the first surface. The receiver may comprise a first hole. The first watch engagement mechanism may comprise a pin and a retaining band engaged with the pin. The pin may be selectably engagable with the first hole. The retaining band may define a structure having a perimeter to which an associated watch may be selectively removably and securely engaged about the perimeter so as to prevent slippage of the watch band relative to the perimeter of the structure.

Further provided is a watch storage apparatus comprising a housing and a plurality of watch engagement mechanisms. The housing may comprise a base. The base may comprise a first surface and a receiver engaged with the first surface. The receiver may have a first hole. The housing may have a first position and a second position. Each watch engagement mechanism may have a pin and a first retaining band. The pin may be selectively engagable with a first hole. A retaining band may define a structure having a perimeter to which an associated watch may be selectively removably and securely engaged about said perimeter so as to prevent slippage of the watch relative to the perimeter of the structure.

Further provided is a method of storing a watch, comprising the steps of: providing a watch storage apparatus, securing the watch to the retaining band, and securing the pin into the hole of the receiver. The watch storage apparatus may comprise, a housing having a base, and a watch engagement mechanism. The housing having a base may comprise a first surface and a receiver engaged with the first surface. The receiver may have a first hole. The watch engagement mechanism may have a pin, and a first retaining band operatively connected to the pin. The first retaining band may define a structure having a perimeter to which an associated watch is selectively removably and securely engaged about the perimeter so as to prevent slippage of the watch relative to the perimeter of the structure.

Further provided is a watch storage apparatus comprising a base, a receiver, a cylindrical ball lock pin, a handle, a retaining band, a housing, and a motor. The base may comprise a first surface and may comprise horizontal surface engagement elements or vertical surface engagement elements. The receiver may be engaged with the first surface and may comprise a cylindrical first hole and a catch surface. The cylindrical ball lock pin may be selectively engagable with the first hole and may comprise a selectably releasable locking ball, a spring, and a shaft. The shaft may be movable by a user to selectably release the locking ball. The pin may have a diameter defining a locational clearance fit with respect to the cylindrical first hole. The handle may be engaged with the pin. The retaining band may be selectively engagable with the pin. The retaining band may define a structure to which an associated watch band of an associated watch may be removably and securely engaged. The retaining band may comprise a flexible strap bent to define a substantially dimpled limaçon cross-section. The substantially dimpled limaçon cross-section may comprise a gap and a concavity. The motor may be operationally engagable with the pin and the base.

According to one aspect of the present invention, a new and improved watch engagement mechanism is provided which may comprise a base and a first watch engagement mechanism. The base may comprise a first surface and a receiver engaged with the first surface. The receiver may comprise a first hole. The first watch engagement mechanism may comprise a pin and a retaining band engaged with the pin. The pin may be selectably engagable with the first hole. The retaining band may define a structure having a perimeter to which an associated watch may be selectively removably and securely engaged about the perimeter so as to prevent slippage of the watch band relative to the perimeter of the structure.

Another object of the present invention is to provide a watch storage apparatus which may further comprise a handle engaged with the pin It is yet another object of the present invention to provide a watch storage apparatus wherein the retaining band comprises a flexible strap bent to define a substantially dimpled limaçon cross-section.

Still another object of the present invention is to provide a watch storage apparatus wherein the substantially dimpled limaçon cross-section comprises a gap and a concavity.

Another object of the present invention is to provide a watch storage apparatus further comprising a housing enclosing the first watch engagement mechanism Yet another object of the present invention is to provide a watch storage apparatus which may further comprise a motor operationally engagable with the watch engagement mechanism, wherein the watch engagement mechanism is adapted to rotate relative to the base.

Further, another object of the present invention is to provide a watch storage apparatus, which may further comprise a plurality of watch engagement mechanisms.

Another object of the present invention to provide a watch storage apparatus wherein the base is adapted to be positioned on an associated wall.

Still another object of the present invention to provide a watch storage apparatus wherein the watch remains securely engaged to the perimeter of the structure upon positioning of the base on the wall.

Yet another object of the present invention to provide a watch storage apparatus wherein the handle further comprises a first elongated portion oppositely disposed from a second elongated portion, wherein the retaining band is operatively connected to the first elongated portion.

Further, another object of the present invention to provide a watch storage apparatus further comprising a second retaining band operatively connected to the second elongated portion.

Further provided is a watch storage apparatus comprising a housing and a plurality of watch engagement mechanisms. The housing may comprise a base. The base may comprise a first surface and a receiver engaged with the first surface. The receiver may have a first hole. The housing may have a first position and a second position. Each watch engagement mechanism may have a pin and a first retaining band. The pin may be selectively engagable with a first hole. A retaining band may define a structure having a perimeter to which an associated watch may be selectively removably and securely engaged about the perimeter so as to prevent slippage of the watch relative to the perimeter of the structure.

It is yet another object of the present invention to provide a watch storage apparatus wherein the retaining band is engaged with a cylindrical ball lock pin, the cylindrical ball lock pin being selectively engagable with the first hole; and the cylindrical ball lock pin comprising, a selectably releasable locking ball; a spring; and a shaft, the shaft being movable by a user to selectably release the locking ball.

Another object of the present invention to provide a watch storage apparatus further comprising a handle engaged with the pin, the handle having a first elongated portion oppositely disposed from a second elongated portion; a second retaining band, wherein the first retaining band is operatively connected to the first elongated portion and the second retaining band is operatively connected to the second elongated portion, each of the first retaining band and the second retaining band having a flexible strap bent to define a substantially dimpled limaçon cross-section.

Further, another object of the present invention to provide a watch storage apparatus wherein the first position of the housing is vertical and the second position of the housing is non-vertical.

Further provided is a method of storing a watch, comprising the steps of: providing a watch storage apparatus, securing the watch to the retaining band, and securing the pin into the hole of the receiver. The watch storage apparatus may comprise, a housing having a base, and a watch engagement mechanism. The housing having a base may comprise a first surface and a receiver engaged with the first surface. The receiver may have a first hole. The watch engagement mechanism may have a pin, and a first retaining band operatively connected to the pin. The first retaining band may define a structure having a perimeter to which an associated watch is selectively removably and securely engaged about the perimeter so as to prevent slippage of the watch relative to the perimeter of the structure.

Another object of the present invention is to provide a method of storing a watch further comprising the step of mounting the watch storage apparatus to a wall.

Another object of the present invention is to provide a method of storing a watch further comprising the step of: releasing the pin from the receiver; releasing the watch from the retaining band; and re-engaging the pin into the receiver.

Further provided is a watch storage apparatus comprising a base, a receiver, a cylindrical ball lock pin, a handle, a retaining band, a housing, and a motor. The base may comprise a first surface and may comprise horizontal surface engagement elements or vertical surface engagement elements. The receiver may be engaged with the first surface and may comprise a cylindrical first hole and a catch surface. The cylindrical ball lock pin may be selectively engagable with the first hole and may comprise a selectably releasable locking ball, a spring, and a shaft. The shaft may be movable by a user to selectably release the locking ball. The pin may have a diameter defining a locational clearance fit with respect to the cylindrical first hole. The handle may be engaged with the pin. The retaining band may be selectively engagable with the pin. The retaining band may define a structure to which an associated watch band of an associated watch may be removably and securely engaged. The retaining band may comprise a flexible strap bent to define a substantially dimpled limaçon cross-section. The substantially dimpled limaçon cross-section may comprise a gap and a concavity. The motor may be operationally engagable with the pin and the base.

DETAILED DESCRIPTION

Reference will be made to the drawings, FIGS. 1-37 wherein the showings are only for purposes of illustrating certain embodiments of an apparatus for storing a watch, and not for purposes of limiting the same.

Figure 28:
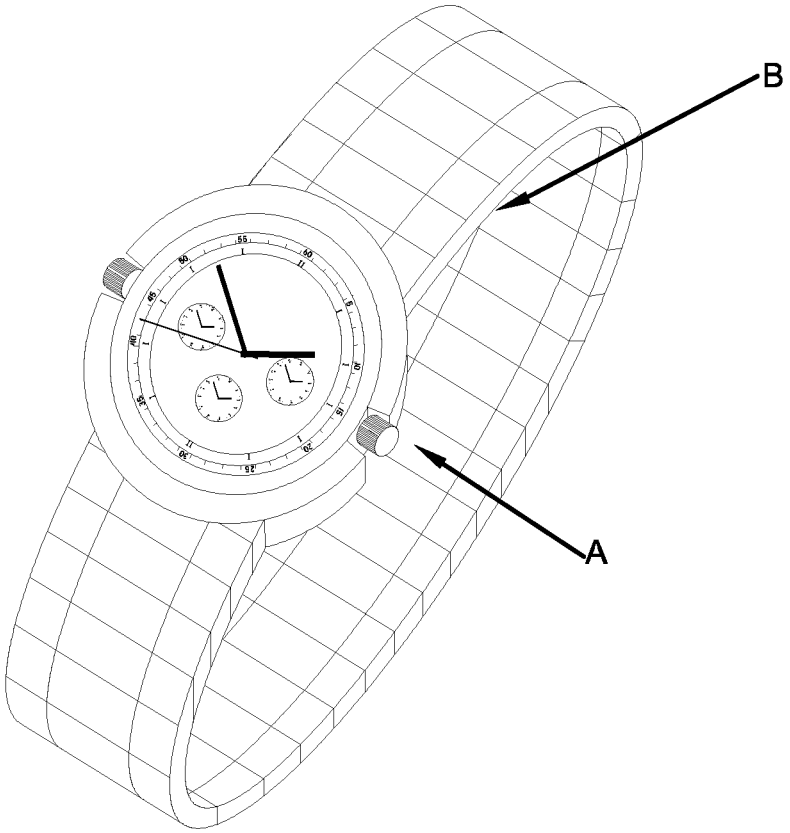
FIG. 28 shows a generic and non-limiting embodiment of a wrist watch.

A wrist watch is a timepiece adapted to being worn about a wrist of an associated user. A non-limiting embodiment of a wrist watch A ("watch") is shown in FIG. 28. The watch A comprises a wrist band B. The wrist band B is a part that may be used to engage the watch A with a wrist of an associated user. The wrist band B may comprise a strap and buckle (not shown), a clasp, hook and loop fasteners, an expandable bracelet (not shown), or any other arrangement useful for engagement about the wrist of an associated user.

An apparatus for storing a watch A is a watch storage apparatus. The watch storage apparatus 100 comprises a base 2095, 2195, and a watch engagement mechanism 2000, 2100. The watch engagement mechanism 2000, 2100 comprises a pin 130, and a retaining band 110, 1900. The watch engagement mechanism 2000, 2100 may, optionally, comprise a plurality of retaining bands 110, 1900 attached to a single pin 130. The watch storage apparatus 100 may comprise the watch engagement mechanism 2000, 2100, comprising the retaining band 110, 1900, and the pin 130, and the base 2095, 2195 comprising a receiver 140. The watch storage apparatus 100 may, optionally, comprise a connector 120, a first support strap 150, a housing 170, a motor 2910, or some combination thereof. The watch engagement mechanism 2000, 2100 may, optionally, comprise a connector 120 engaged with the pin 130 and with the retaining band 110, 1900. The watch storage apparatus 100 may comprise a plurality of watch engagement mechanisms 2000, 2100.

Figure 19:
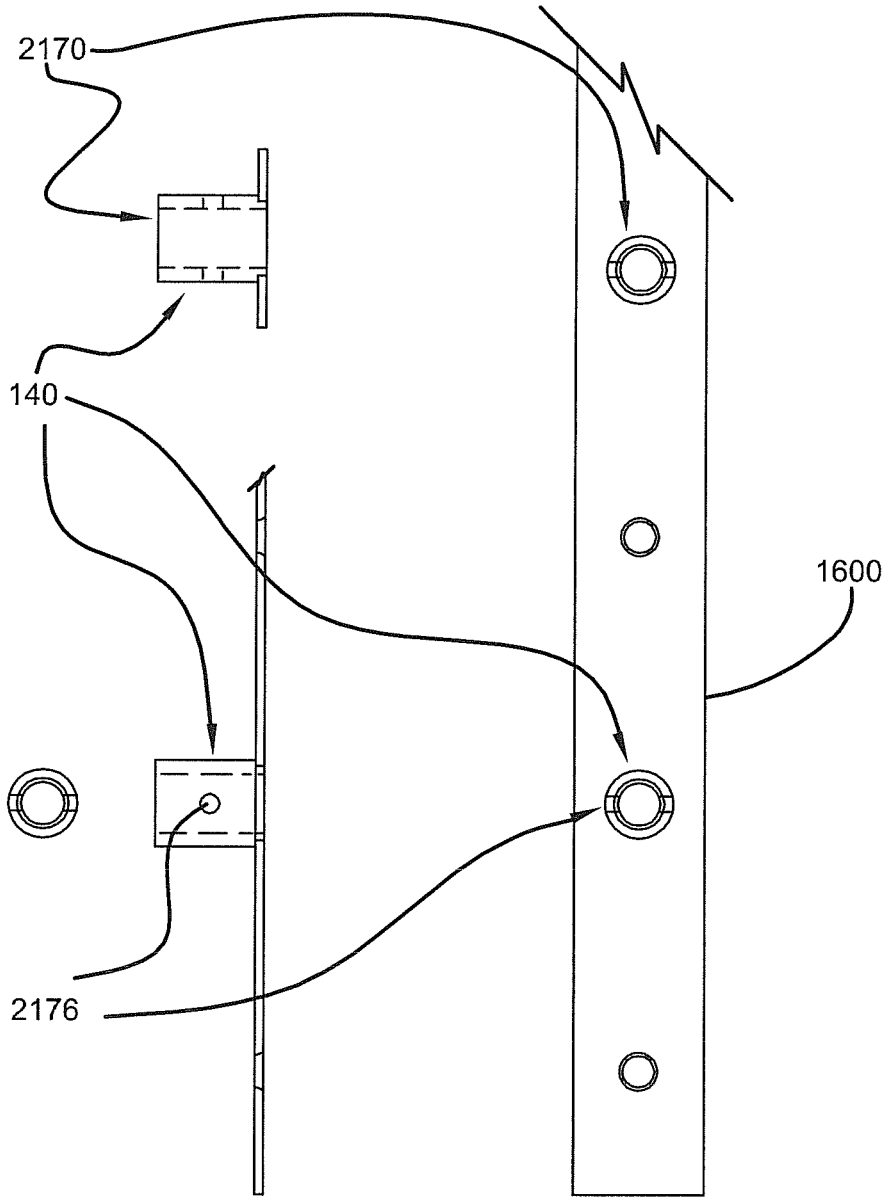
FIG. 19 shows multiple views of one embodiment of an elongated strap and receivers.
Figure 20:
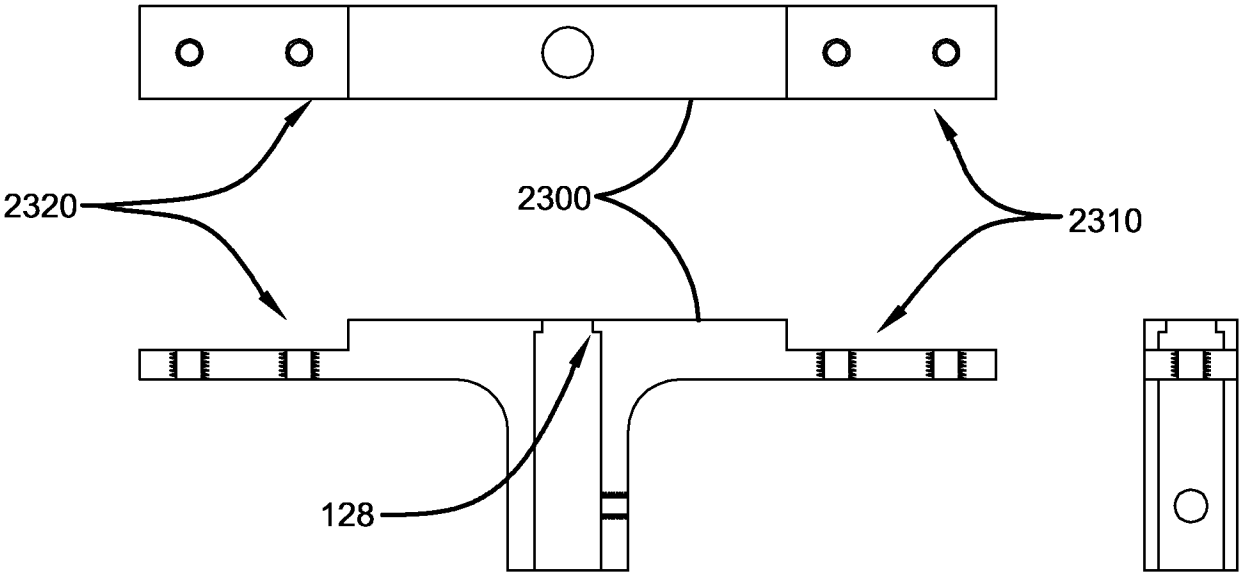
FIG. 20 shows multiple views of an embodiment of a handle.
Figure 21:
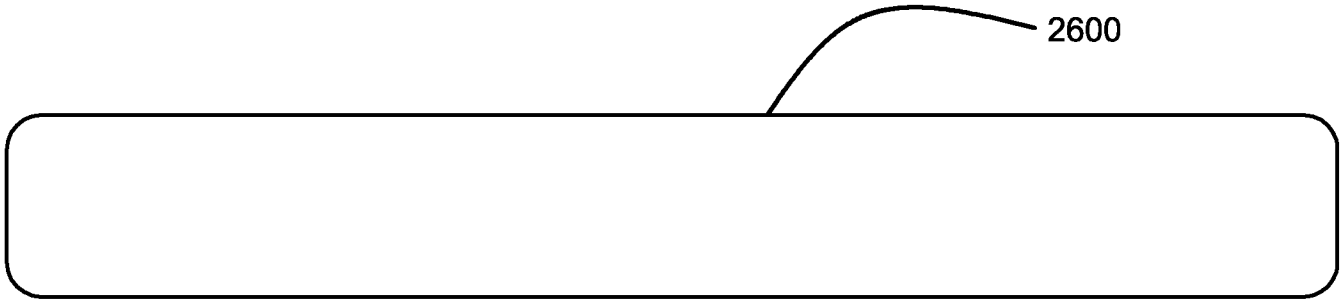
FIG. 21 shows an embodiment of a retaining band blank.
Figure 27:
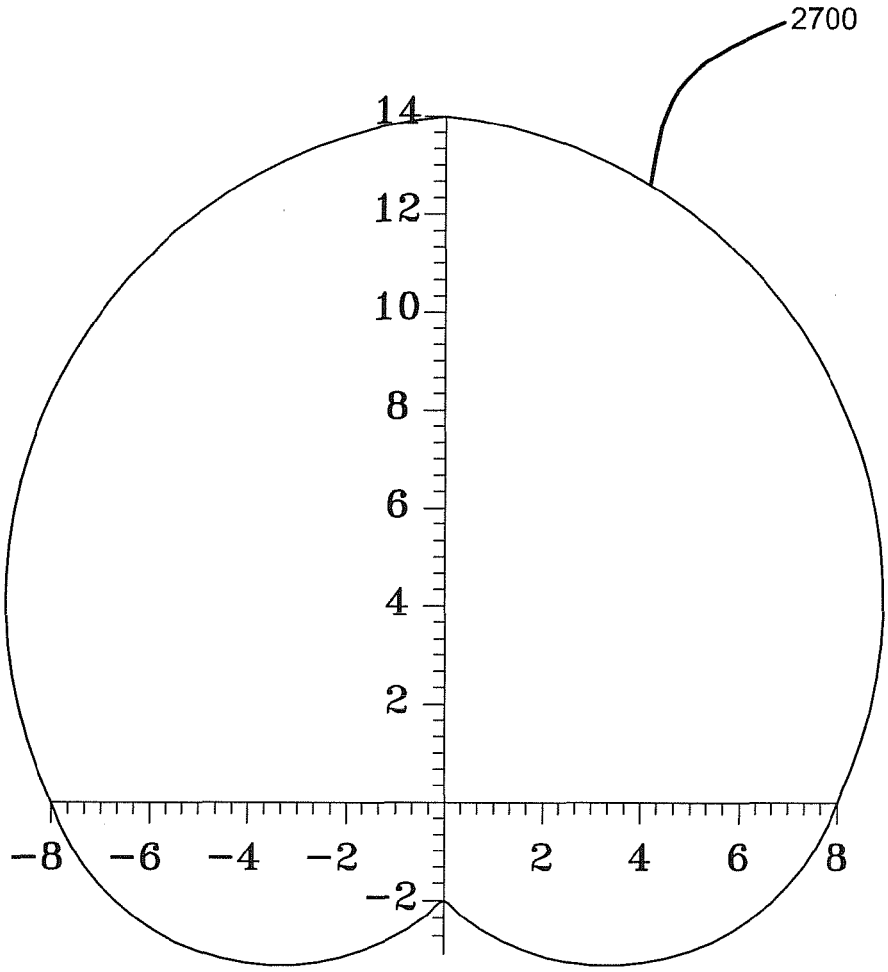
FIG. 27 shows an embodiment of a limaçon.

The retaining band 110, 1900 is a component adapted to releaseably engage an associated watch A. The retaining band 110, 1900 is a component that substantially mimics that portion of the geometry of the wrist of an associated user that engages watch band B when watch A is worn, such that the watch A may be engaged with the retaining band 110, 1900 in a manner similar to the manner with which it may be engaged with the wrist of an associated user. The retaining band 110, 1900 comprises a loop or block or other structure defining a substantially wrist-shaped perimeter about which or to which the watch A may be engaged. The watch A may be selectively removably and securely engaged about the perimeter of the retaining band 110, 1900 so as to prevent slippage of the watch band relative to the perimeter of the retaining band 110, 1900. The retaining band 110, 1900 comprises a loop or block or other structure with a cross-section having a perimeter defining a limaçon, or a defining a perimeter substantially similar to a limaçon, about which the watch A may be engaged. One non-limiting embodiment of a limaçon is shown in FIG. 27. A limaçon 2700 is a shape for which the equation in polar coordinates (r, θ) has the form: $r=b+a\cos\theta$, or $r=b+a\sin\theta$, where "a" is a constant and "b" is a constant. The non-limiting embodiment of a limaçon 2700 defined by the equation: $r=8+6\sin\theta$ in shown in FIG. 27. A limaçon may be dimpled, looped, or cusped. As shown in FIG. 19, in certain embodiments, the perimeter of retaining band 110, 1900 approximates a section of a dimpled limaçon and defines a substantially wrist-shaped perimeter about which the wrist band B may be engaged.

The retaining band 110, 1900 may comprise an open loop, a closed loop, or a block. As shown in FIGS. 13, 14, 21, and 22, without limitation, the retaining band 110, 1900 may comprise a strap of material 2600 formed into an open loop. In one embodiment, a block retaining band (not shown) has no free ends but may be subject to slight elastic deformation. In one embodiment, a closed loop retaining band (not shown) has no free ends but may be subject to slight elastic deformation. In one embodiment, an open loop retaining band 1900 has two free ends 1910 and 1920 separated by a gap 1970. The free ends 1910 and 1920 may be moved with respect to one another by substantial distances by elastically deforming the retaining band 1900. The open or closed nature of the retaining band 110, 1900, that is, whether the retaining band 110, 1900 comprises an open loop and a gap, or a closed loop and no gap, may substantially affect its flexibility, rigidity and/or its effective modulus of elasticity.

Figure 13:
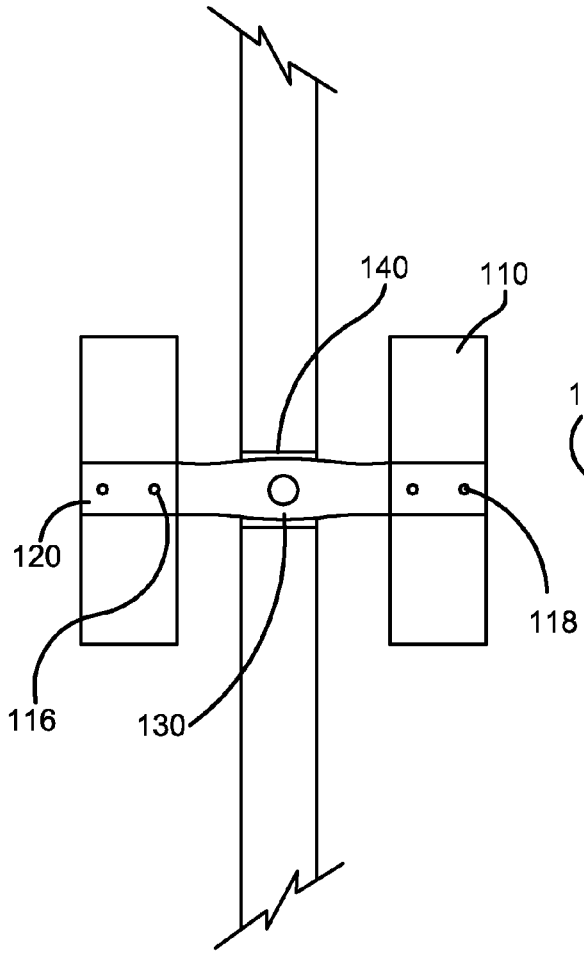
FIG. 13 is a top view of an embodiment of a watch engagement mechanism.
Figure 14:
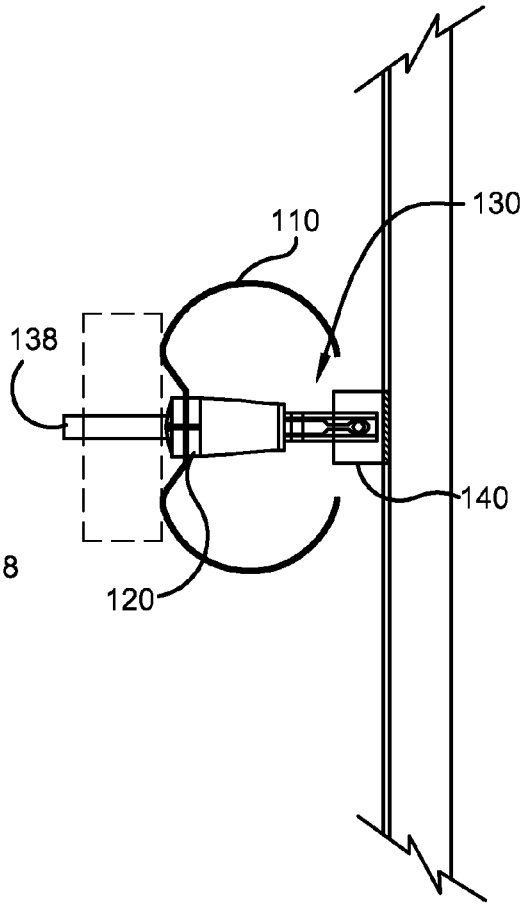
FIG. 14 is a side view of an embodiment of a watch engagement mechanism.
Figure 22:
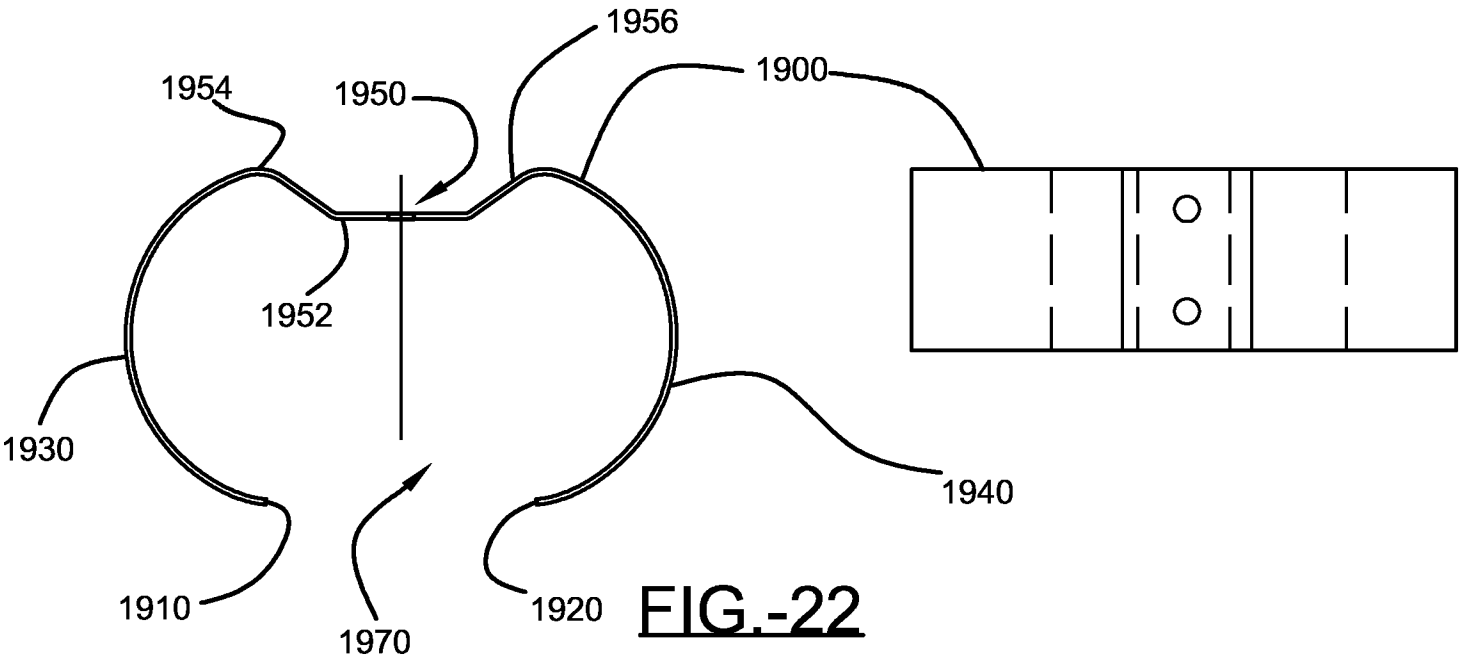
FIG. 22 shows multiple views of an embodiment of a retaining band.
Figure 23:
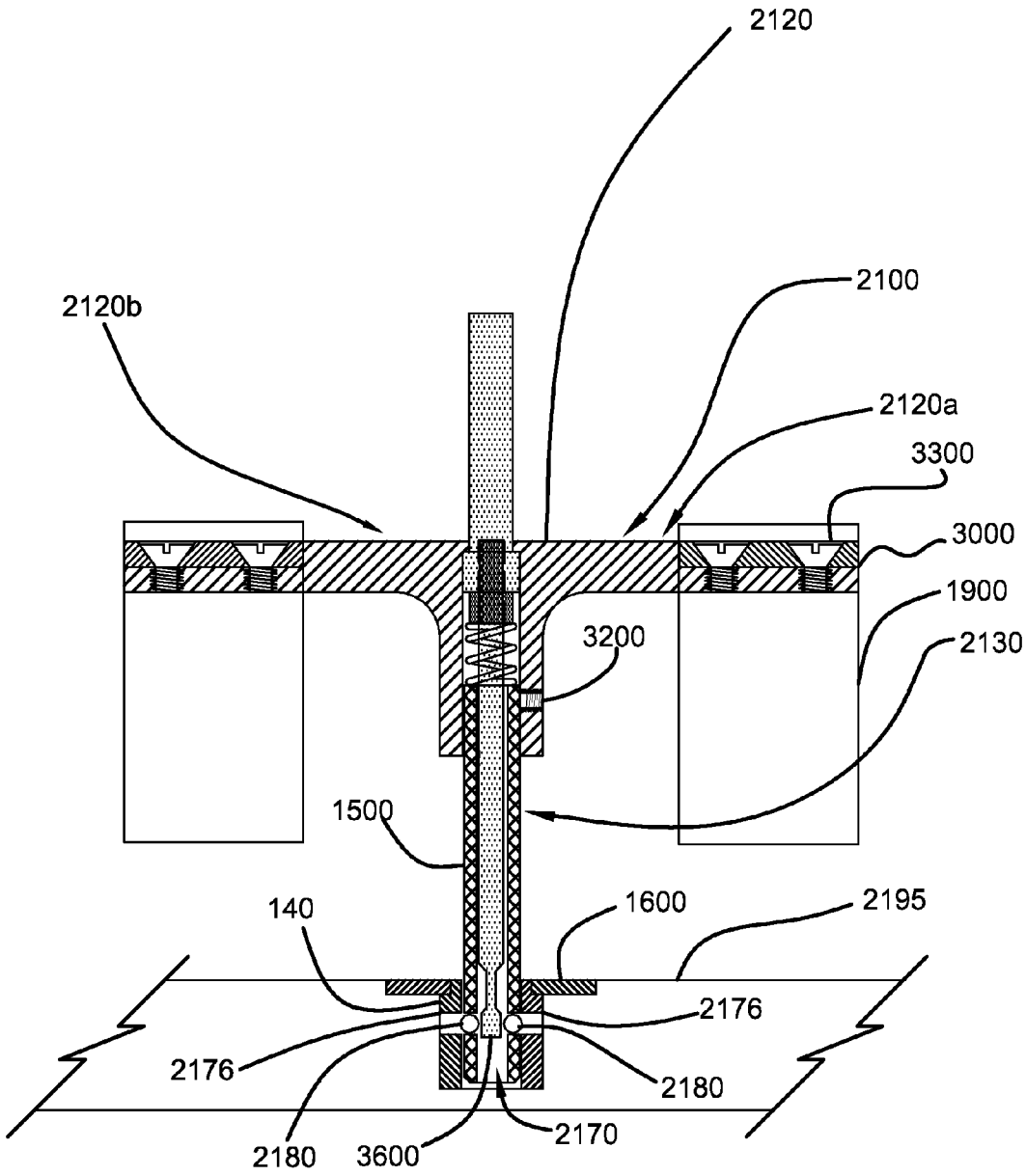
FIG. 23 shows a partial cross-sectional front view of a watch engagement mechanism.
Figure 24:
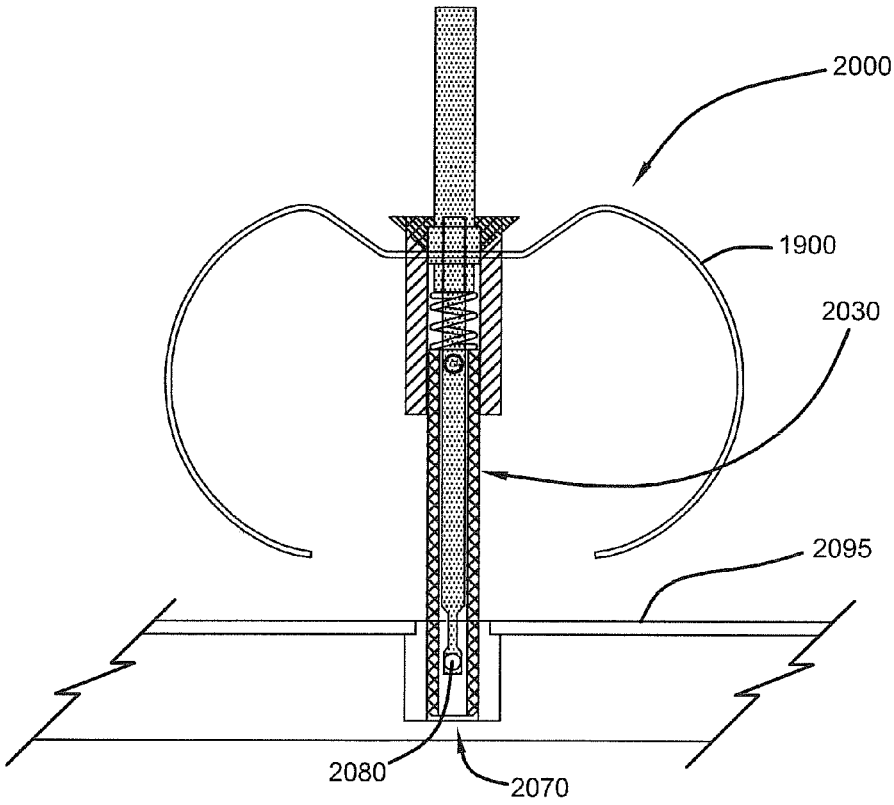
FIG. 24 shows a partial cross-sectional side view of a watch engagement mechanism.
Figure 25:
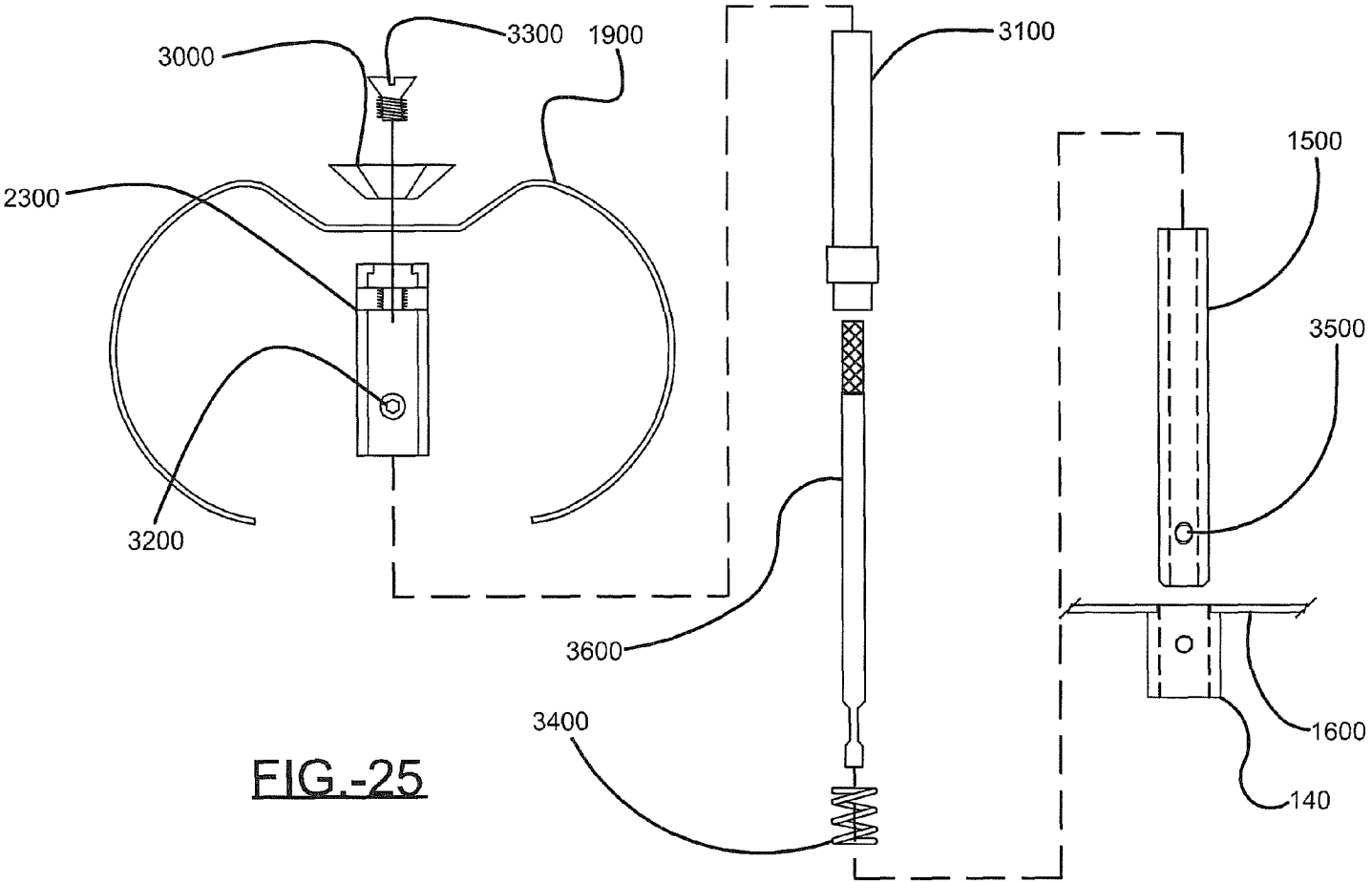
FIG. 25 shows an exploded side view of a watch engagement mechanism.
Figure 26:
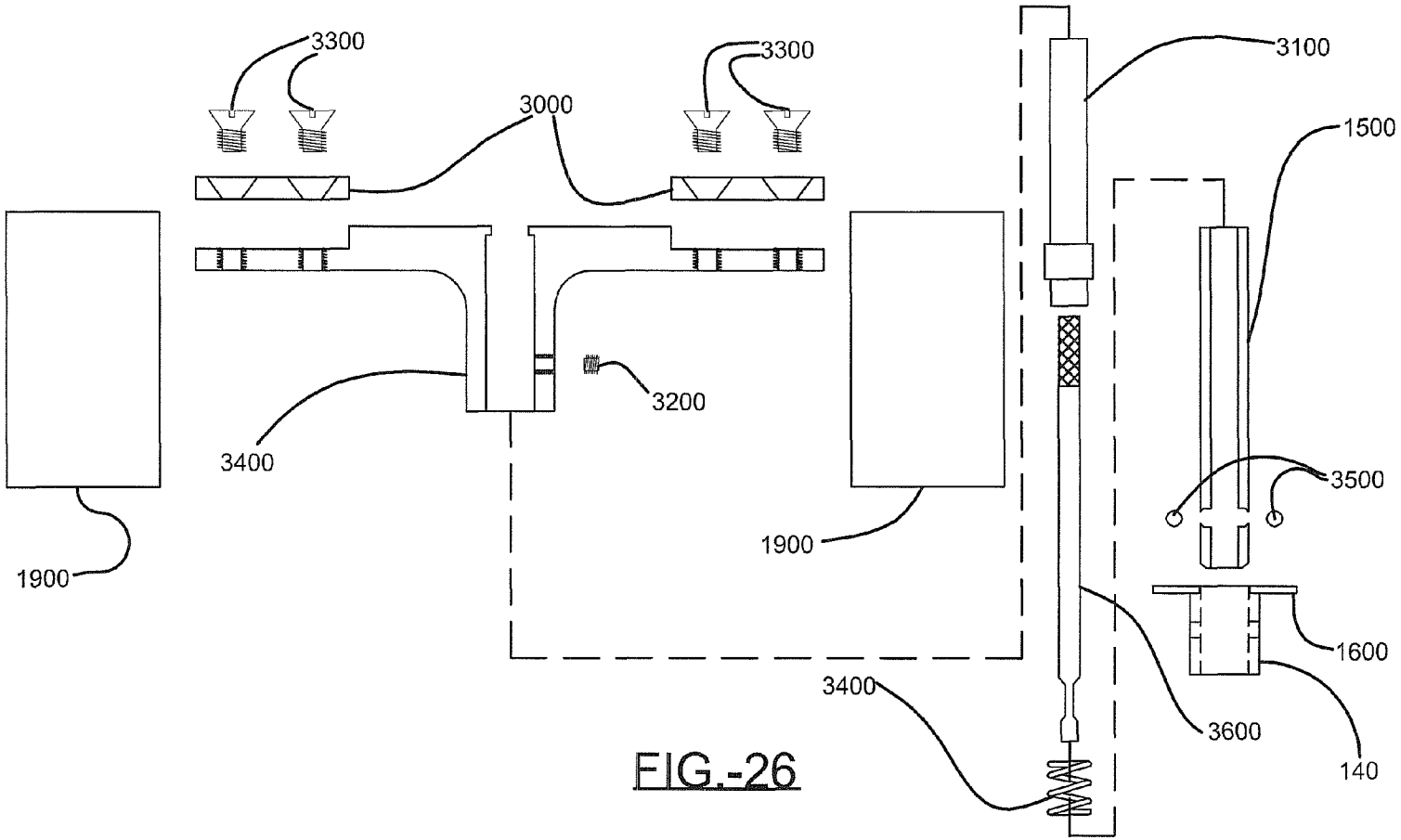
FIG. 26 shows an exploded front view of a watch engagement mechanism.

In certain embodiments, the retaining band 110, 1900 may comprise or act as a flexible spring in order to provide a restorative force in response to deflection. The restorative force from the retaining band 110, 1900 may act to improve fit and holding forces in engagement of the retaining band 110, 1900 with the wrist band B. As shown in FIGS. 13, 14, and 22 without limitation, the retaining band 110, 1900 may comprise a material and geometry that allows it to act as a flexible hysteretic spring.

The retaining band 110 comprises adaptations for engagement 114 to the connector 120 or the pin 130. Adaptations for engagement 114 may comprise a hole 116 adapted to accept a mechanical fastener 118, 3300, threaded elements, grooves, dove tails, or other engineering appropriate design elements. The hole 116 may comprise a through hole, a blind hole, a threaded hole, or a slot. As shown in FIGS. 13 and 14, without limitation, adaptations for engagement 114 may comprise a plurality of through holes 116 each adapted to accept mechanical fastener 118, 3300 such that mechanical fastener 118, 3300 engages retaining band 110 to connector 120.

Figure 1:
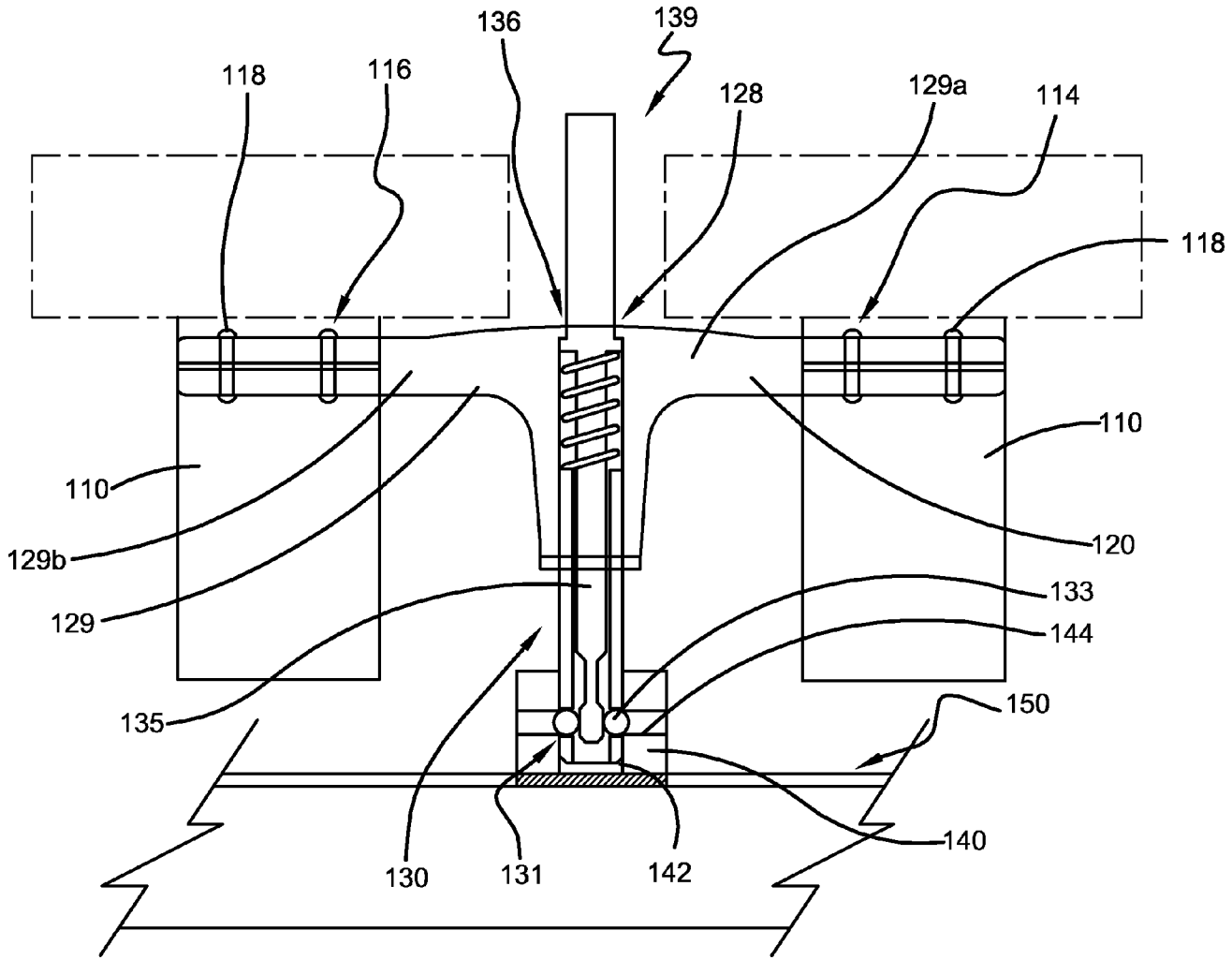
FIG. 1 is front view of an embodiment of a watch engagement mechanism.
Figure 2:
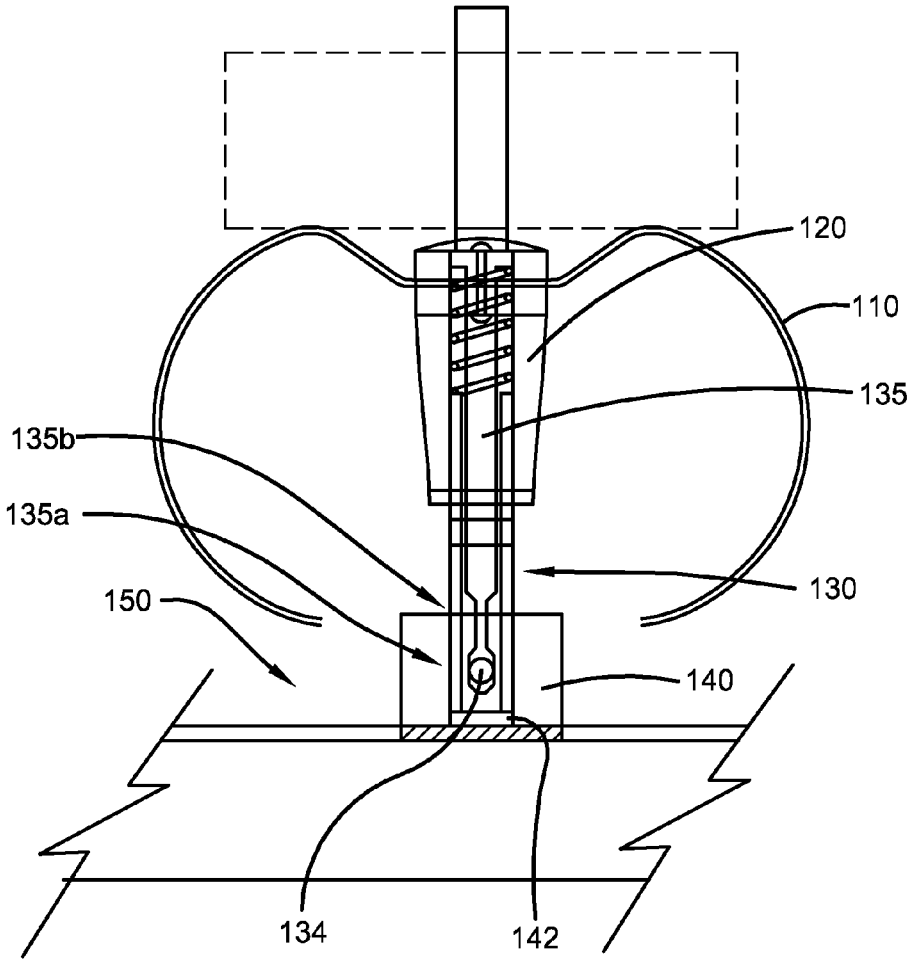
FIG. 2 is a side view of an embodiment of a watch engagement mechanism.
Figure 4:
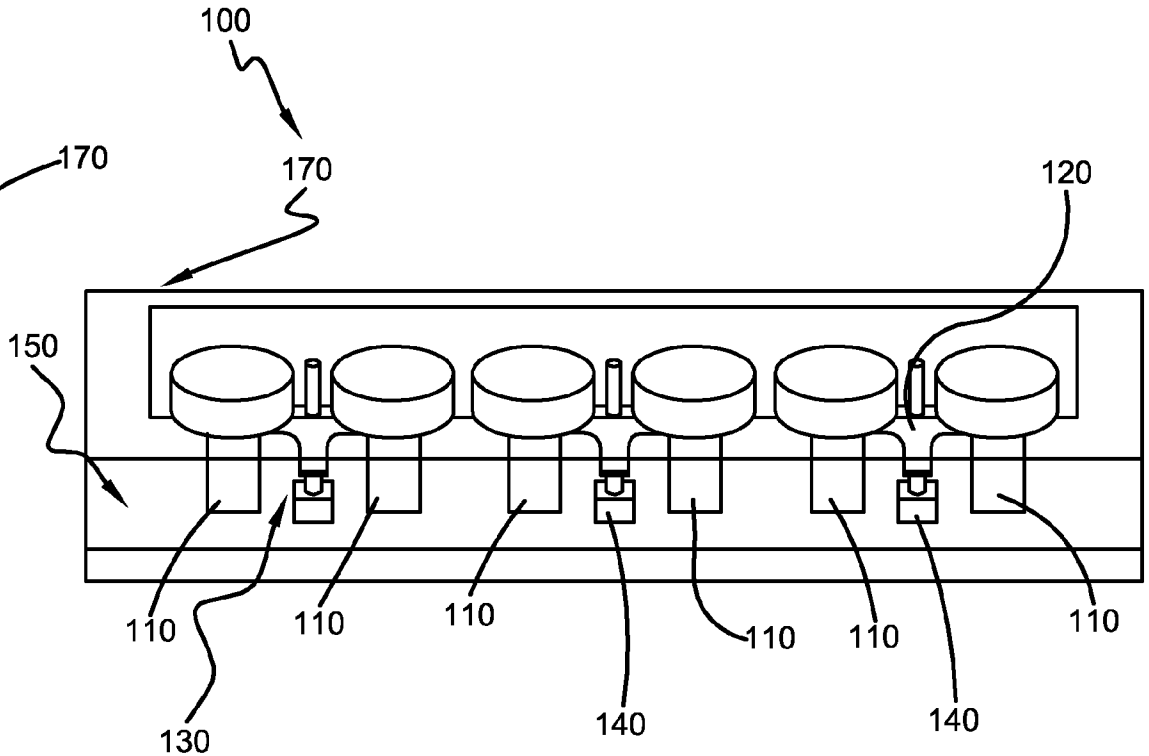
FIG. 4 is a front view of an embodiment of an apparatus for storing a watch.
Figure 3:
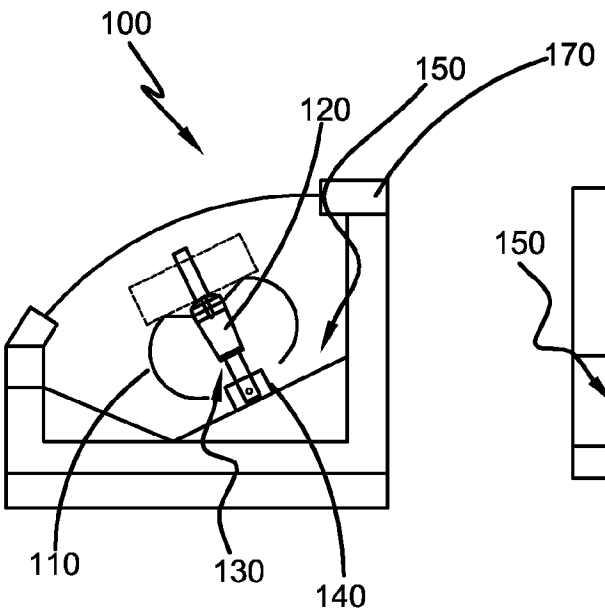
FIG. 3 is a side view of another embodiment of an apparatus for storing a watch.
Figure 5:
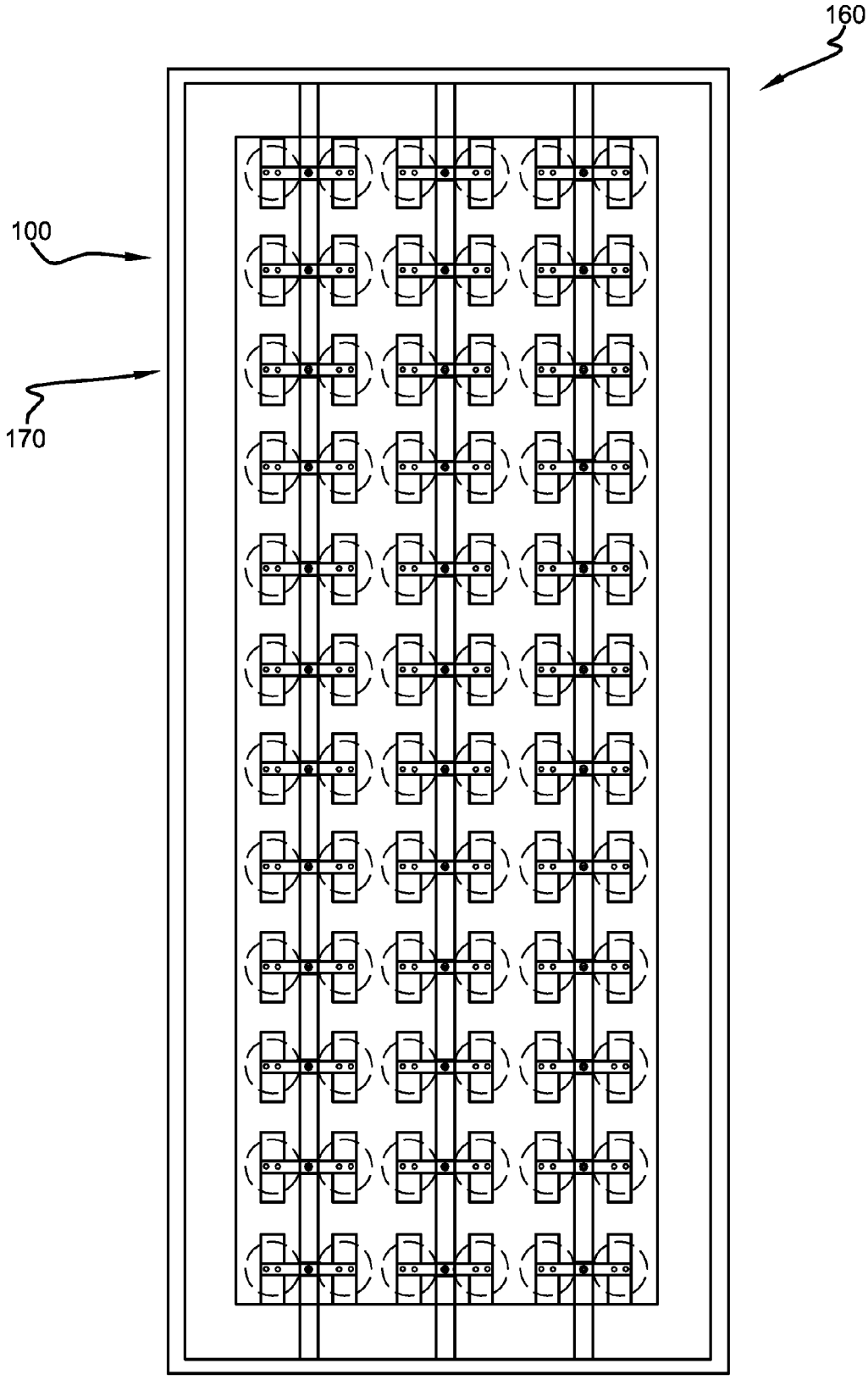
FIG. 5 is a front view of another embodiment of an apparatus for storing a watch.
Figure 6:
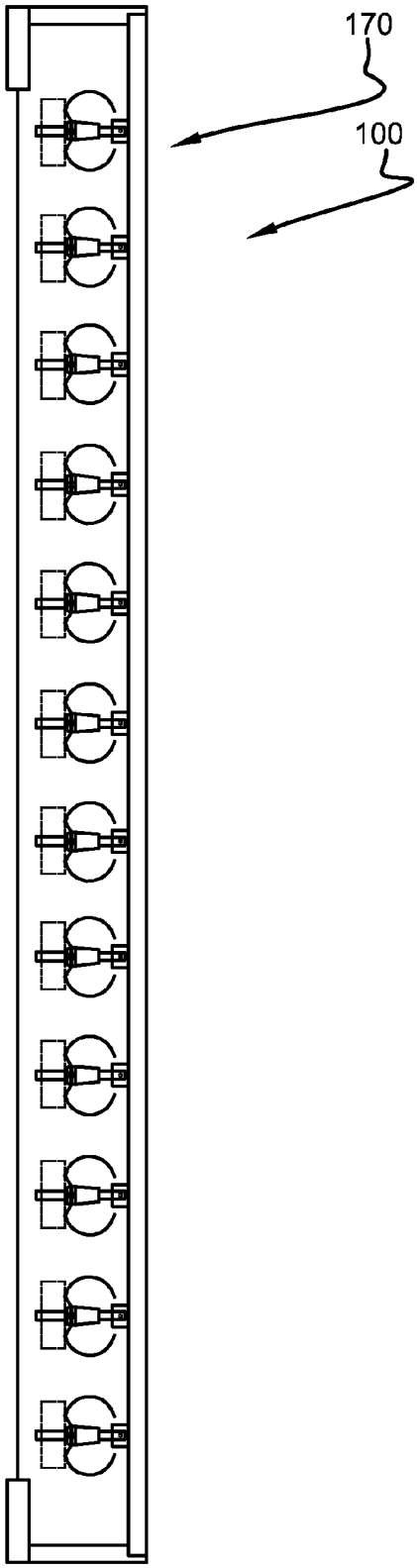
FIG. 6 is a side view of an embodiment of an apparatus for storing a watch.
Figure 7:
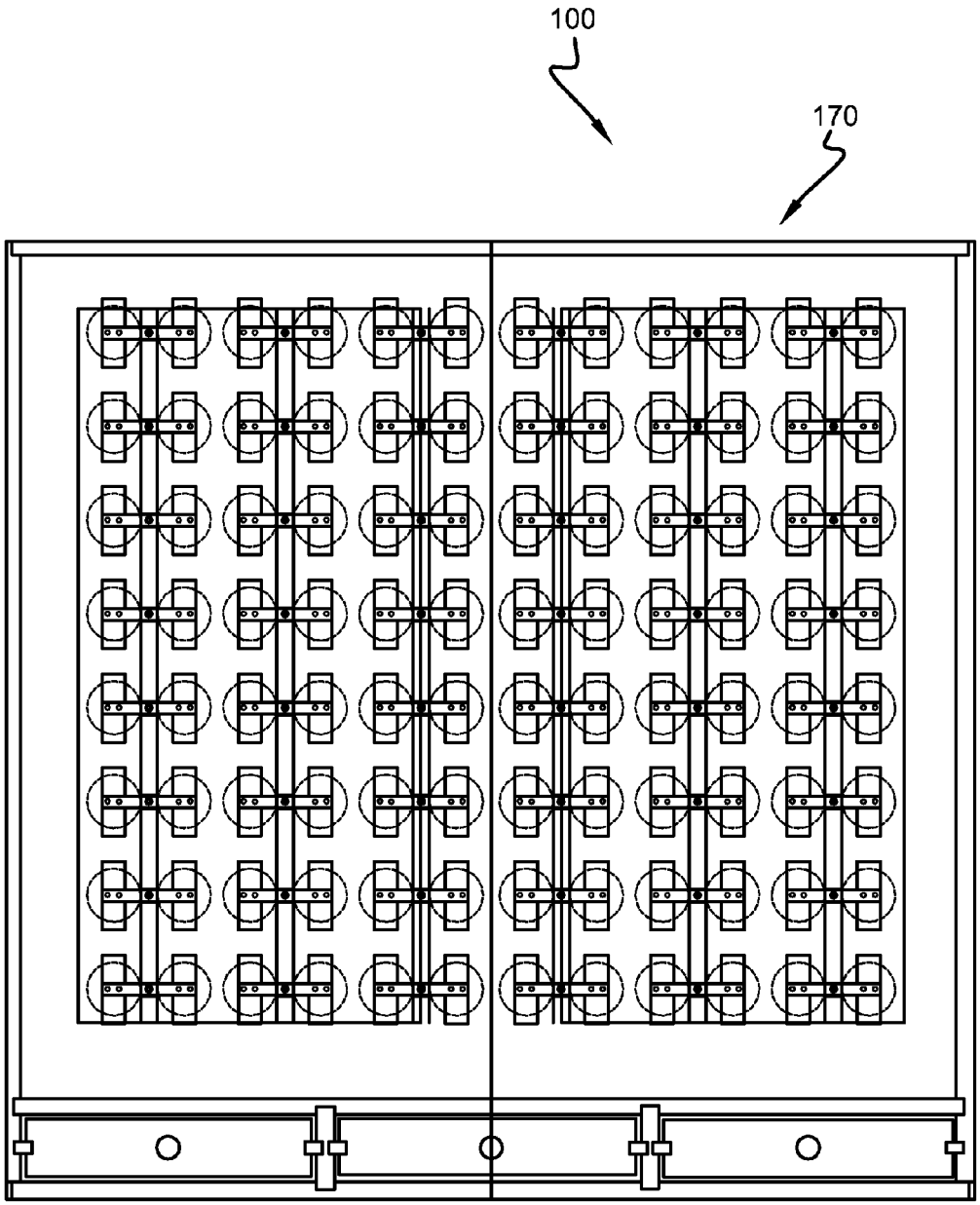
FIG. 7 is a front view of another embodiment of an apparatus for storing a watch.
Figure 8:
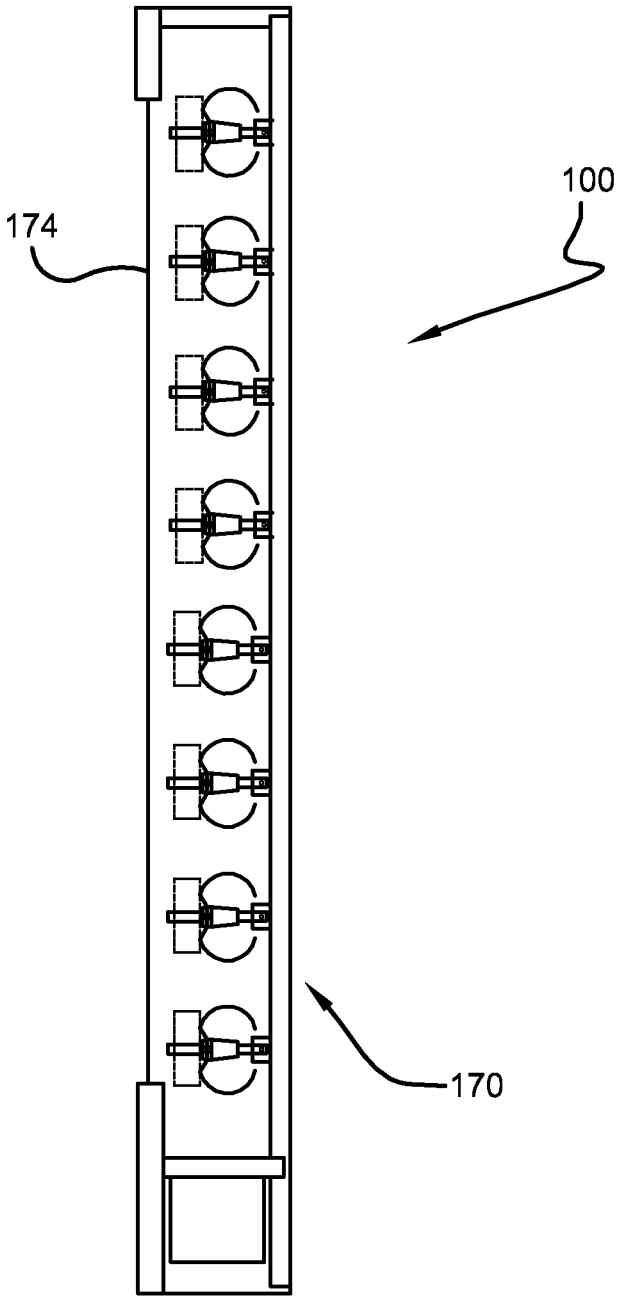
FIG. 8 is a side view of an embodiment of an apparatus for storing a watch.
Figure 9:
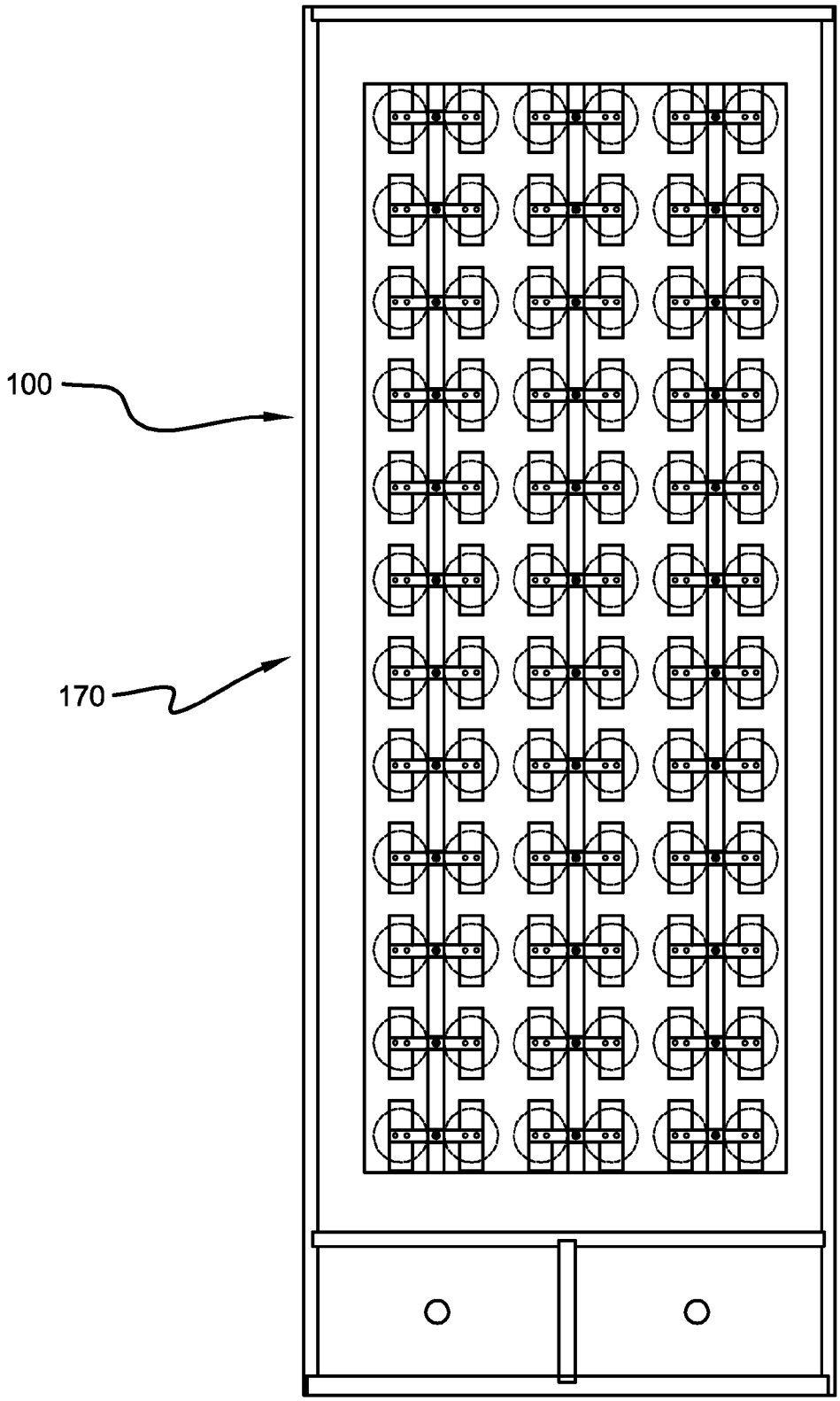
FIG. 9 is a front view of another embodiment of an apparatus for storing a watch.
Figure 10:
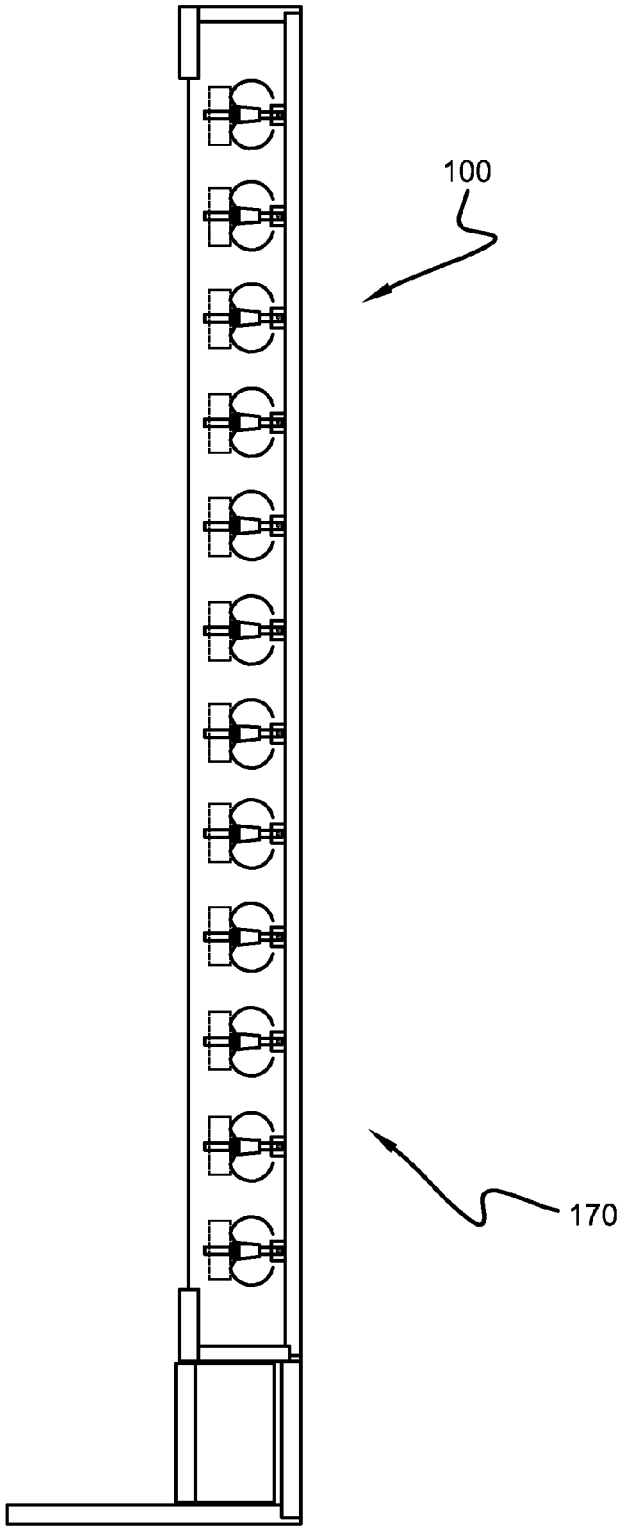
FIG. 10 is a side view of an embodiment of an apparatus for storing a watch.
Figure 11:
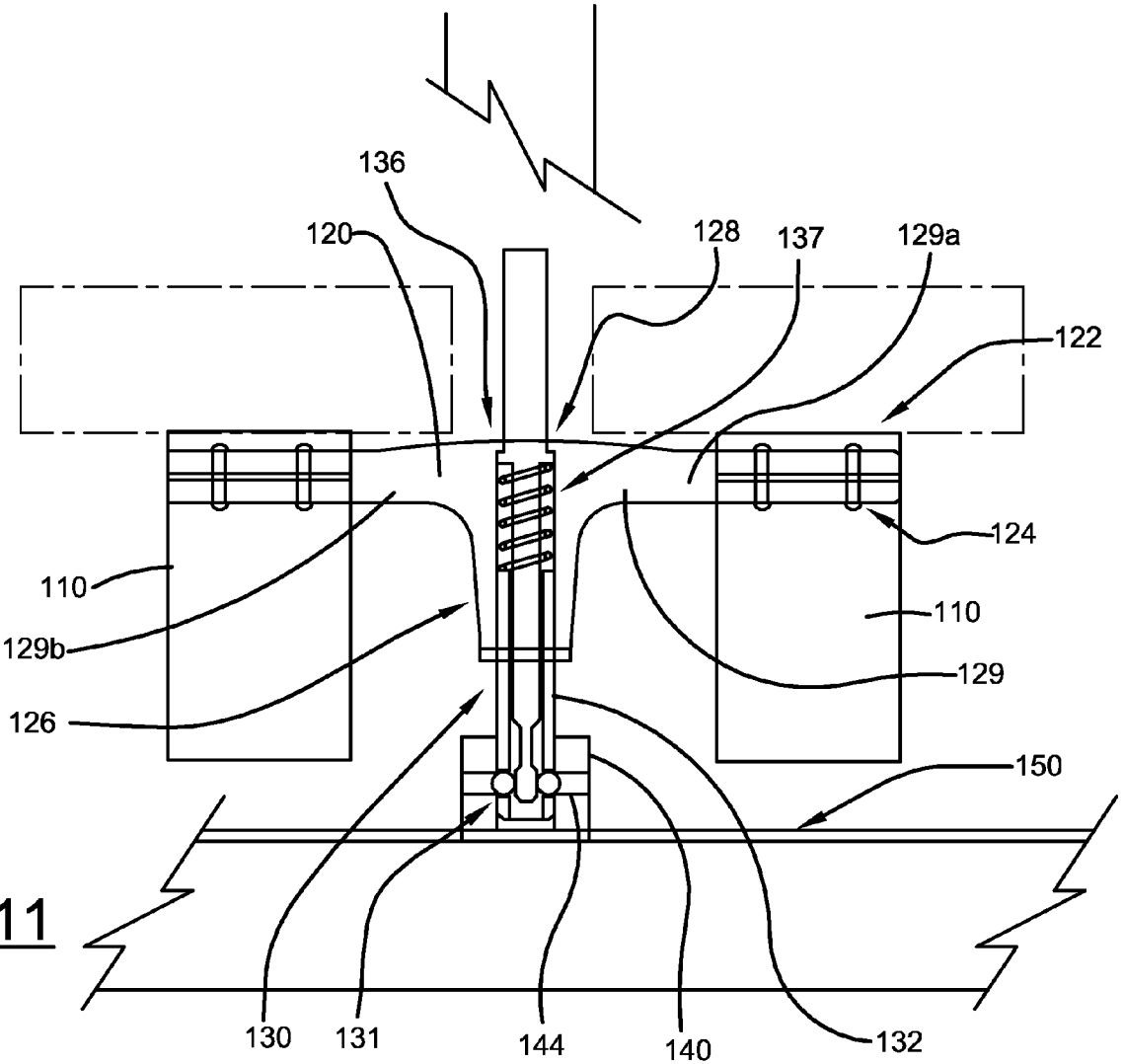
FIG. 11 is a front view of an embodiment of a watch engagement mechanism.
Figure 12:
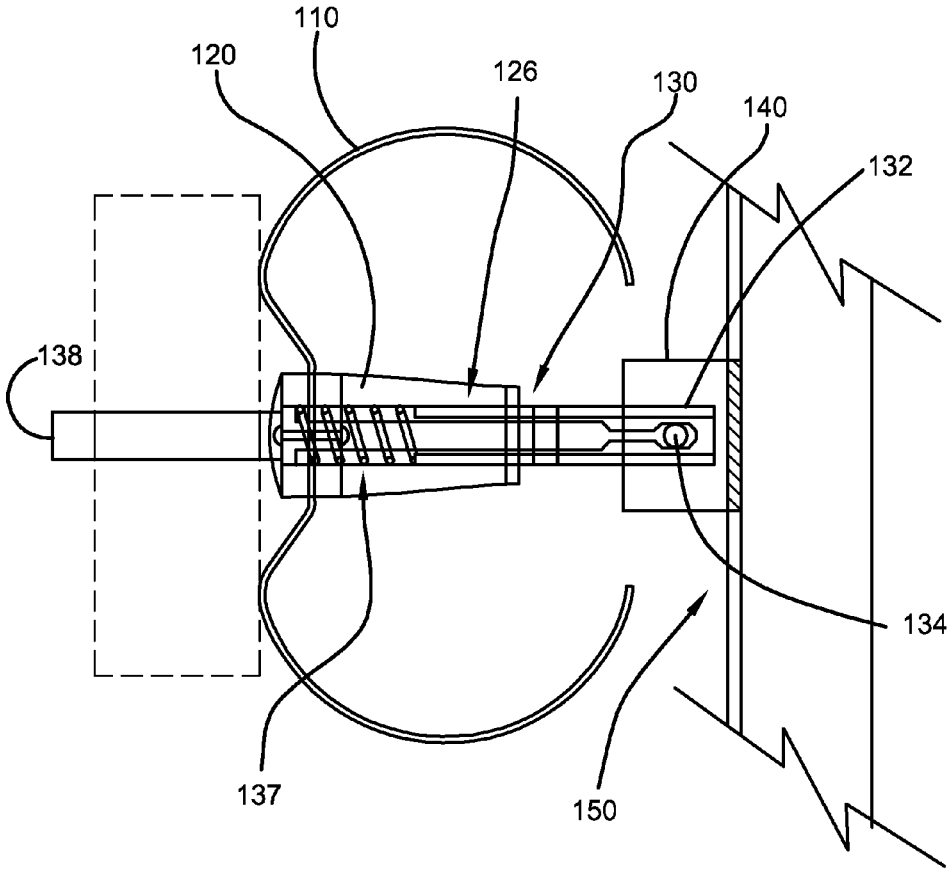
FIG. 12 is a side view of an embodiment of a watch engagement mechanism.

The geometry of the retaining band 110, 1900 shown in the accompanying FIGS. 12, 14, and 22, is believed to be universal in nature such that any associated watch will be able to be securely fit onto it without disengaging and about the perimeter of which an associated watch may be selectively removably and securely engaged so as to prevent slippage of the watch relative to said perimeter of said retaining band 110, 1900. In one embodiment, the specific geometry of the retaining band 1900 comprises a first convex outer portion 1930 and a second convex outer portion 1940 interconnected by a generally concave portion or concavity 1950. The concavity 1950 includes a substantially planar base 1952 having a first upwardly sloping end 1954 and a second upward sloping end 1956 that interconnect with the respective convex outer portions 1930 and 1940. In the embodiment shown in FIG. 22, the retaining band 1900 is formed from a flexible strap, such as a thin metallic strap, such as the blank 2600 shown in FIG. 21, bent into the desired shape. In the embodiment shown in FIG. 22, the retaining band 1900 comprises a series of bends to approximate a section of a dimpled limaçon.

The connector 120 may be any component adapted to provide operational engagement between the retaining band 110 and pin 130. In certain embodiments, such as that shown in FIG. 1, the connector 120 may engage a plurality of retaining bands 110 and the pin 130. The connector 120 comprises adaptations for engagement 122 to retaining band 110. In certain embodiments, adaptations for engagement 122 may comprise a hole 124 adapted to accept a mechanical fastener, threaded elements, grooves, dove tails, or other engineering appropriate design elements. Hole 124 may comprise a through hole, a blind hole, a threaded hole, or a slot. As shown in FIGS. 13 and 14, without limitation, adaptations for engagement 122 may comprise a plurality of through holes 122 each adapted to accept mechanical fastener 118, 3300. The connector 120 comprises adaptations for engagement 126 to pin 130. In certain embodiments, adaptations for engagement 126 may comprise a hole 126 adapted to accept the pin 130. Hole 126 may comprise a flange 128 or lip adapted to operationally engage a component of pin 130. The connector 120, may be engaged with pin 130 with an over molding, an ultrasonic weld, a press-fit, an adhesive, a resin, a mechanical fastener, a threaded element, other engineering appropriate design elements, or some combination thereof.

The connector 120 may comprise or consist of a handle 129, 2120, 2300 adapted to be gripped, grasped, pushed, pulled, torqued, or otherwise manipulated by the hand or fingers of an associated user. The handle 129, 2120, 2300 may comprise a first elongated portion 129*a*, 2120*a*, 2310. The handle 129, 2120, 2300 may comprise a first elongated portion 129*a*, 2120*a*, 2310 and a second elongated portion 129*b*, 2120*b*, 2320 oppositely disposed from the first elongated portion 129*a*, 2120*a*, 2310 wherein retaining band 110 is operatively connected to the first elongated portion 129*a*, 2120*a*, 2310. In certain embodiments, a second retaining band 110 may be operatively connected to the second elongated portion 129*b*, 2120*b*, 2320.

In the embodiments shown in FIGS. 23, 24, 25, and 26, the retaining band 1900 may be secured to the handle 2300 by being clamped between the handle 2300 and a clamping block 3000. The clamping block 3000 is secured to the handle 2300 by a fastener 3300. In certain embodiments, the clamping block 3000 may be coated or shrouded by material to protect it or to protect an associated watch A. The clamping block 3000 may be comprise an anodized coating, a polymeric coating, a leather shroud, or other coatings or shrouds.

Figure 15:
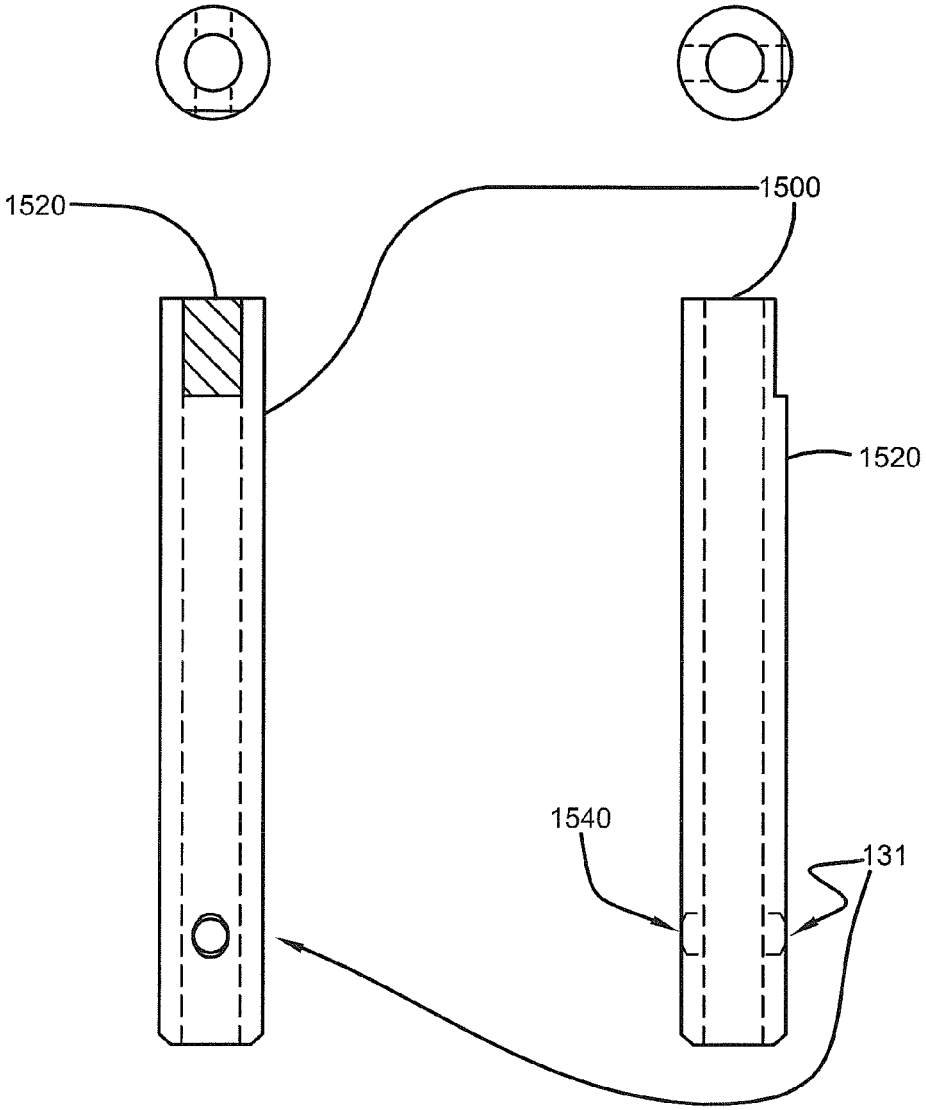
FIG. 15 shows multiple views of an embodiment of an elongated shaft.
Figure 16:
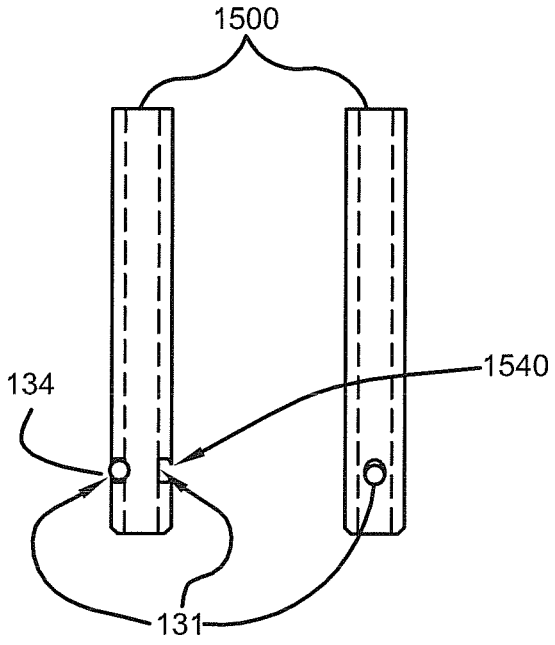
FIG. 16 shows multiple views of an embodiment of an elongated shaft.

The pin 130 is a component adapted to provide operational engagement between the connector 120 and the receiver 140. The pin 130 comprises an elongated shaft 132, 1500. The elongated shaft 132, 1500 is adapted to be releasably engaged with receiver 140. The elongated shaft 132, 1500 of pin 130 may be engaged with connector 120 with over molding, ultrasonic welds, press-fits, adhesives, resins, or some combination thereof. In the embodiments shown in FIGS. 23, 24, 25, and 26, the elongated shaft 1500 is engaged to the handle 2120 with a set screw 3200. As shown in FIG. 15, in certain embodiments, the elongated shaft 1500 may comprise a flat 1520 or other region adapted to engage with a set screw 3200. In certain embodiments, elongated shaft 132, 1500 comprises a hole, detent, or cavity 131 adapted to accept an engagement component 133. In certain embodiments, an engagement component 133 may comprise a locking ball 134, 3500. As shown in FIGS. 15 and 16 the cavity 131 may comprise a cavity 131 having a clearance fit with respect to locking ball 134 and further comprising eccentricities, teeth, or other retention elements 1540 which allow the locking ball 134 to partially protrude from the cavity 131 but will retain the locking ball 134 to prevent it from falling out. Elongated shaft 132, 1500 may have a cross-section that is substantially circular, elliptical, square, hexagonal, or any other configuration corresponding to appropriate engineering considerations. Elongated shaft 132, 1500 may be solid or hollow.

Figure 34:
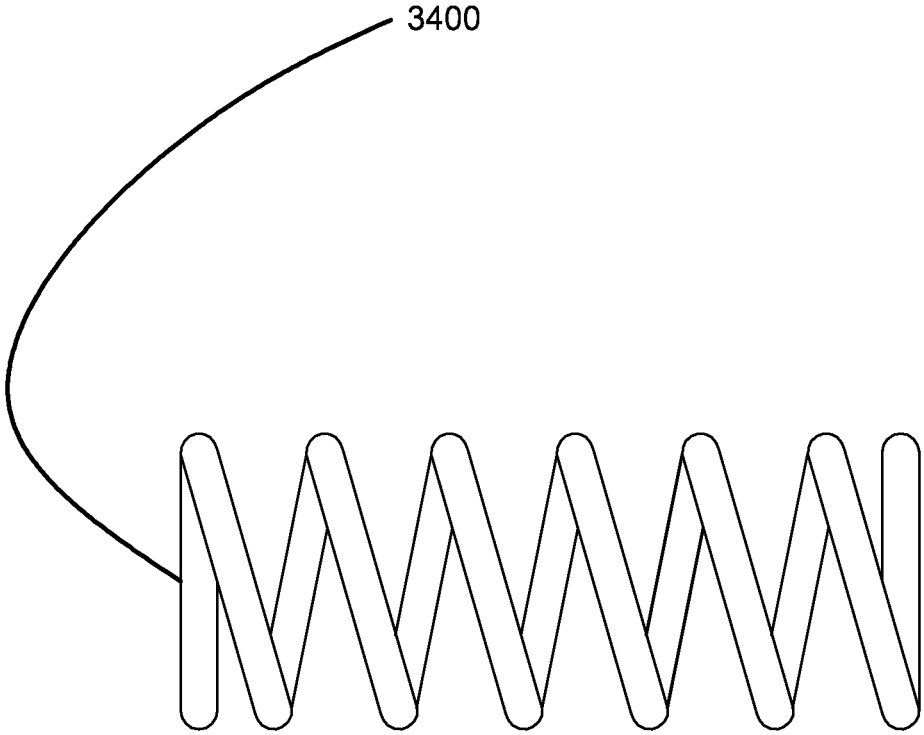
FIG. 34 shows an embodiment of a coil spring.
Figure 35:
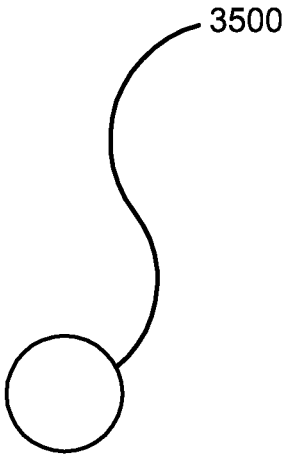
FIG. 35 shows an embodiment of a locking ball.
Figure 36:
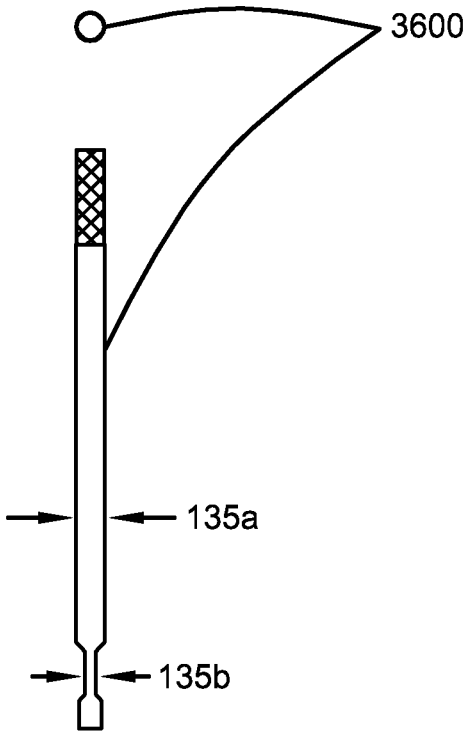
FIG. 36 shows an embodiment of an elongated rod.
Figure 37:
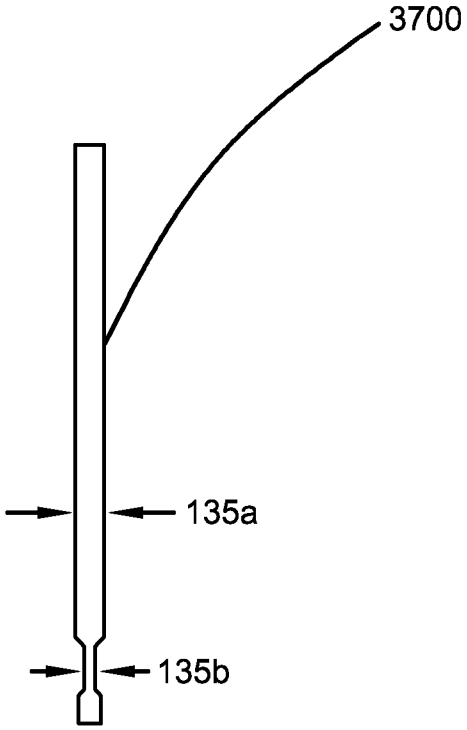
FIG. 37 shows an embodiment of an elongated rod.

As shown in FIGS. 13 and 14, without limitation, in certain embodiments, pin 130 is hollow and is adapted to have at least partially inserted therein an elongated rod 135, 1810, 3600, 3700. The elongated rod 135, 1810, 3600, 3700 is adapted to be moved axially within elongated shaft 132, 1500. Elongated rod 135, 1810, 3600, 3700 is axially locatable at any position within a range of axial positions along elongated shaft 132, 1500. In certain embodiments, the diameter of elongated rod 135, 1810, 3600, 3700 varies axially between a retention diameter 135*a* and a release diameter 135*b*. In certain embodiments, elongated rod 135 may comprise a flange 136, 1820 or lip adapted to operationally engage a component of connector 120, such as, without limitation, the lip or flange 128. In certain embodiments, as shown in FIGS. 23, 24, 25, and 26, elongated rod 135, 1810, 3600, 3700 may engage with a button 3100 where the button 3100 comprises a flange 136 adapted to operationally engage a flange 128. In some embodiments, such as that shown in FIG. 36, the elongated rod 3600 may comprise knurling, barbs, thread or other features adapted to engage the elongated rod 3600 with button 3100. In some embodiments, such as that shown in FIG. 37, the elongated rod 3700 may be smooth. Pin 130 may comprise a spring 137, 3400 adapted to apply a load to elongated rod 135, 1810, 3600, 3700. Spring 137, 3400 may be preloaded to bias elongated rod 135, 1810, 3600, 3700 into a first axial position. As shown in FIG. 34, and without limitation, spring 3400 may be a compression coil spring. In certain embodiments, when the elongated rod 135, 1810, 3600, 3700 is in the first axial position, a portion of elongated rod having the retention diameter 135*a* is in engagement with the engagement component 133, forcing the engagement component 133 radially outward. In certain embodiments, forcing the engagement component 133 radially outward forces the engagement component 133 into a position adapted to engage receiver 140 or components of receiver 140. In certain embodiments, elongated rod 135, 1810, 3600, 3700 comprises or is operationally engaged with a button, extension, or eccentricity 138, 1830, 3100 adapted to permit an associated user to push on or otherwise manipulate the elongated rod in order to move the elongated rod from the first axial position into a second axial position. When the elongated rod 135, 1810, 3600, 3700 is in the second axial position, a portion of elongated rod having a release diameter 135*b* is in engagement with an engagement component 133, allowing engagement component 133 the freedom to move radially inward or outward. Allowing engagement component 133 the freedom to move radially inward or outward allows the engagement component 133 to move out of a position adapted to engage receiver 140 or components of receiver 140 and thereby releases the engagement component 133 from receiver 140 or components of receiver 140. In certain embodiments, engagement component 133 comprises a locking ball 134 that may be released to move radially inward or outward by user selectable positioning of the elongated rod 135, 1810, 3600, 3700.

Figure 17:
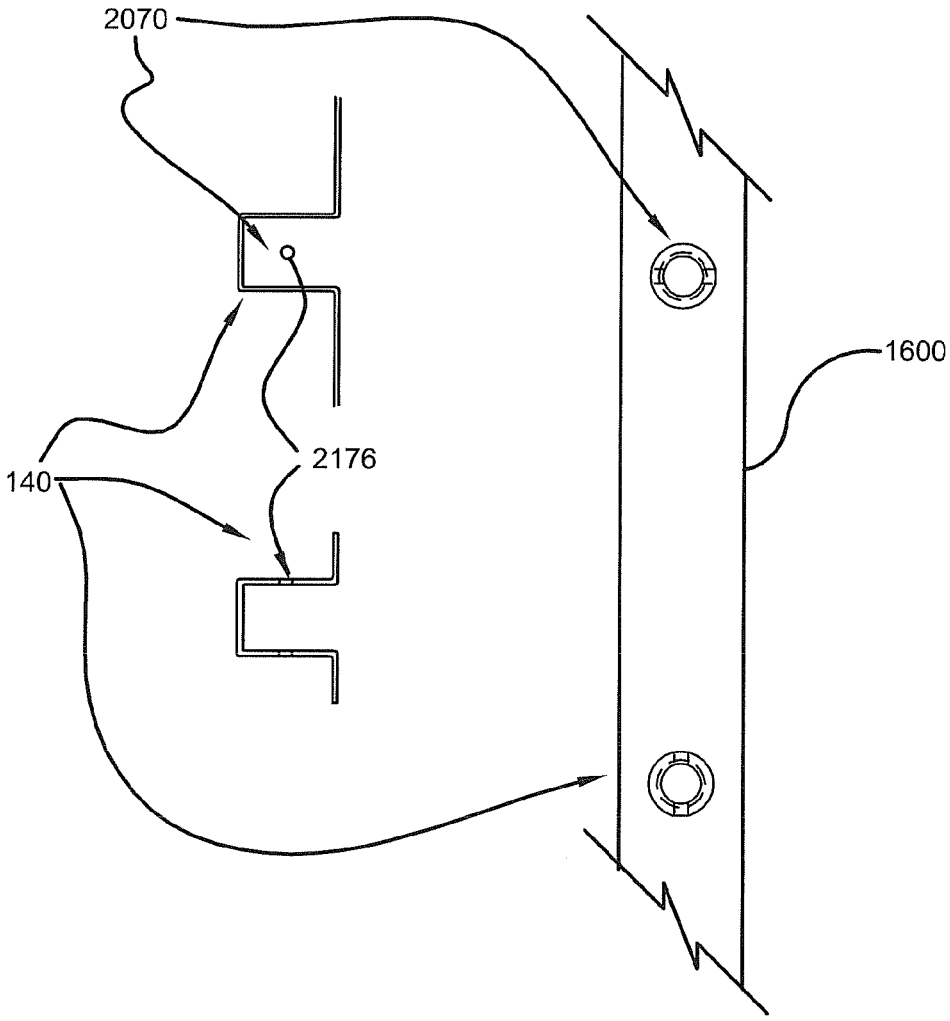
FIG. 17 shows multiple views of one embodiment of an elongated strap and receivers.
Figure 18:
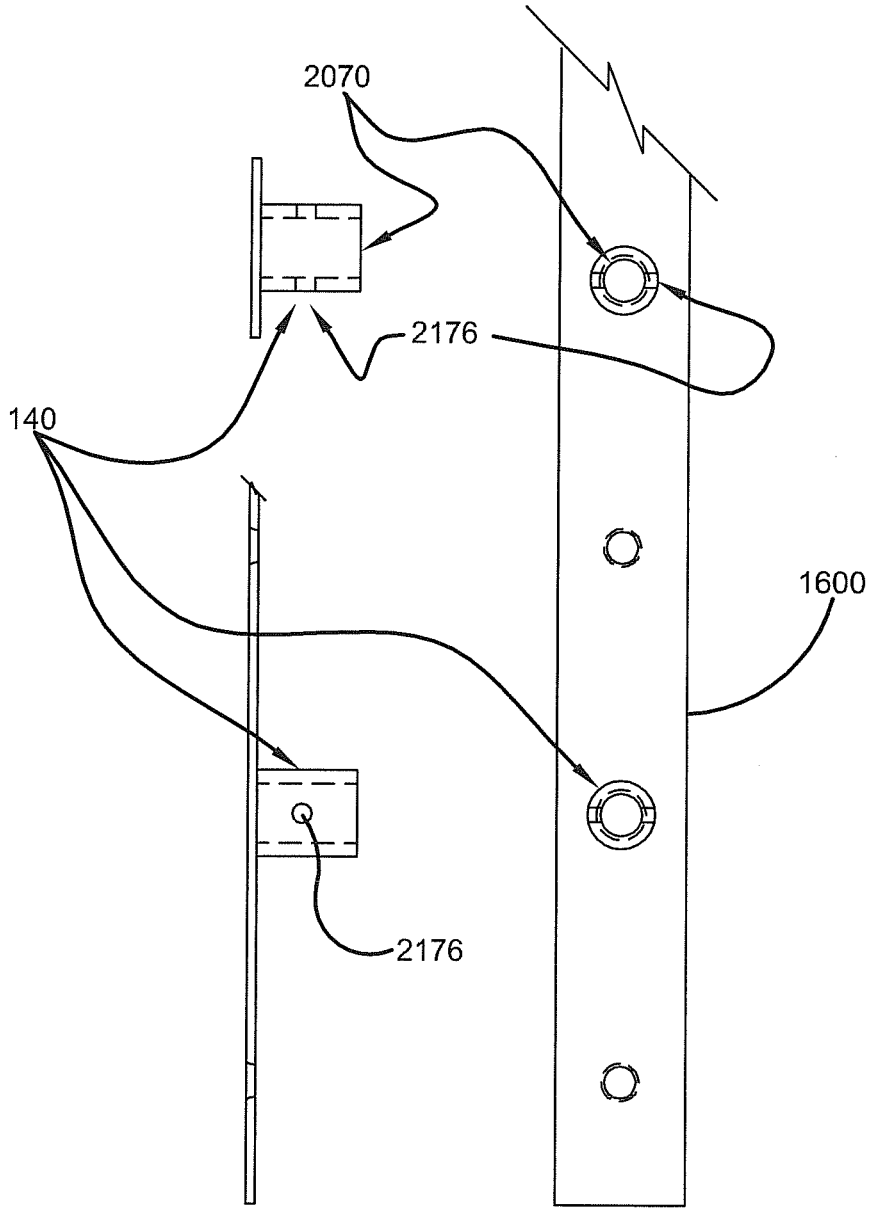
FIG. 18 shows multiple views of one embodiment of an elongated strap and receivers.

In certain embodiments, the pin 130 may be part of a single quick release pin 139 with a head or handle adapted to per-form the engagement functions of the connector 120 to connect pin 130 to retaining band 110. The pin 130 may comprise a conventional ball lock pin 2030, 2130. In some embodiments, as shown in FIGS. 23, 24, 25, and 26, the pin 130 may comprise a cylindrical ball lock pin 2030, 2130 that may be selectively engagable with a cylindrical first hole 2070, 2170 of receiver 140. As shown in FIGS. 17, 18, and 19, in certain embodiments, receiver 140 may comprise one or more catch surfaces 2176 to engage with a selectably releasable locking ball 2080, 2180 of the a cylindrical ball lock pin 2030, 2130. Pin 130 may have a diameter defining a locational clearance fit with respect to a cylindrical first hole 2070, 2170.

The receiver 140 is a component adapted to provide operational engagement between the pin 130 and base 2095, 2195. The receiver 140 may comprise the first hole 142, 2070, 2170 or other cavity adapted to accept elongated shaft 132, 1500. The receiver 140 may further comprise a second hole 144, 2176 or cavity adapted to receive an engagement component 133. In certain embodiments, second hole 144 may be a substantially annular cavity about the perimeter of first hole 142. In those embodiments in which second hole 144 is a substantially annular cavity about the perimeter of first hole 142, when engagement component 133 is engaged with second hole 142, the engagement acts to prevent axial motion of the pin 130 with respect to receiver 140, but will not act to prevent rotational motion of pin 130 about the axis of the pin 130. In certain embodiments, other features such as, without limitation, a non-circular pin 130 in a non-circular first hole 142, may be optionally included to prevent rotational motion of pin 130 about the axis of the pin 130. In certain embodiments, second hole 144, 2176 may be a substantially discrete hole located along the perimeter of first hole 142. In embodiments in which second hole 144, 2176 is a substantially discrete hole located along the perimeter of first hole 142, second hole 144, 2176 may be substantially perpendicular to first hole 142. In embodiments in which second hole 144, 2176 is a substantially discrete hole, when engagement component 133 is engaged with second hole 142, the engagement acts not only to prevent axial motion of the pin 130 with respect to receiver 140, but also to prevent rotational motion of pin 130 about the axis of the pin 130.

Receiver 140 may be engaged directly with the base 2095, 2195 or indirectly to the base through an intermediate component such as a first support strap 150. Engagement of the receiver 140 to the base 2095, 2195 or to the first support strap 150 may be by mechanical fasteners, welds, adhesives, clips, clamps, or other engineering appropriate means. In the embodiment shown in FIG. 17, the receiver 140 is defined by the hole 2070 formed integrally in the base 2095 or first support strap 150. The hole 2070 may be formed integrally in the base 2095 by drawing, molding, stamping, casting or other engineering appropriate means. In the embodiments shown in FIGS. 18 and 19, the receiver 140 is defined by the hole 2170 formed integrally in an intermediate component attached to the base 2095 or first support strap 150. The hole 2170 may be formed integrally in an intermediate component by drawing, molding, stamping, casting or other engineering appropriate means.

First support strap 150, 1600 may be any component adapted to provide operational engagement, directly or indirectly between the receiver 140 and the base 2095, 2195 or the housing 170. As noted above, engagement of the receiver 140 to the first support strap 150, 1600 may be by mechanical fasteners, welds, adhesives, clips, clamps, or other engineering appropriate means. In certain embodiments, as shown in FIG. 17, the receiver 140 may be integrally formed in the first support strap 1600. In certain embodiments, the first support strap 150 is an elongated strap adapted for engagement with the receiver 140. In certain embodiments, receiver 140 may be releasably engaged with first support strap 150 such that receiver 140 may be released, moved along the axis of elongation of first support strap 150 and re-engaged. In certain embodiment, a plurality of assemblies comprising the retaining band 110, the connector 120, the pin 130, the receiver 140, are engaged with the first support strap 150. In certain embodiments, the first support strap 150 is engaged directly to the base 2095, 2195 or to the housing 170. The first support strap 150 may be engaged to the base 2095, 2195 or to the housing 170 by mechanical fasteners, welds, adhesives, clips, clamps, or other engineering appropriate means.

In certain embodiments, the first support strap 150 may engaged to a second support strap (not shown). The first support strap 150 may be engaged to a second support strap (not shown) by mechanical fasteners, welds, adhesives, clips, clamps, or other engineering appropriate means. In certain embodiments, first support strap 150 is substantially elongated and is engaged to a substantially elongated second support strap (not shown). In certain embodiments, the first support strap 150 is substantially elongated and is engaged in a substantially non-parallel arrangement with the substantially elongated second support strap (not shown). The second support strap (not shown) may be engaged to the base 2095, 2195 or to the housing 170 by mechanical fasteners, welds, adhesives, clips, clamps, or other engineering appropriate means.

The base 2095, 2195 is a structure adapted to engage or have formed therein one or more receivers 140. The base 2095, 2195 may comprise a first surface adapted to engage or have formed therein one or more receivers 140. In the embodiment shown in FIG. 17, the receiver is defined by hole 2070 formed integrally in the base. In the embodiment shown in FIG. 23, base 2195 engages a receiver 140 indirectly by engaging an intermediate component 1600 which, in turn, engages or has one or more receivers 140. In the embodiment shown in FIG. 17, first support strap 150 or second support strap (not shown) may be base 2095. The base 2095, 2195 may be adapted for attachment to or to be positioned on a wall (not shown) or other vertical structure by surface engagement elements such as mechanical fasteners, welds, adhesives, clips, clamps, or other engineering appropriate means. The base 2095, 2195 may be adapted for attachment to a table or other horizontal structure by surface engagement elements such as mechanical fasteners, welds, adhesives, clips, clamps, or other engineering appropriate means. In certain embodiments, the associated watch A attached thereto remains securely engaged to the perimeter of the structure defined by the retaining band upon positioning of said base on the wall. As described further herebelow, the base 2095, 2195 may be part of, or integrally connected with, the housing 170.

The housing 170 is a structure adapted to comprise or engage or have the base 2095, 2195. The housing 170 may enclose the watch engagement mechanism 2000, 2100. The housing 170 may comprise a first openable enclosure 174 adapted to isolate the contents therein, such as, without limitation a plurality of watch engagement mechanisms 2000, 2100, a plurality of the first support strap 150 and/or one or more of a second support strap 160. The housing may comprise a plurality of openable enclosures 174 including, without limitation cabinets and drawers. In certain embodiments the housing 170 may be substantially resistant to water, fire, tampering, or theft. In certain embodiments, the housing 170 may be waterproof, fireproof, and/or bulletproof. The housing 170 may comprise a seal, insulation, batting, shock absorbent material, intumescent material, a lock, a window, hinges, or combinations thereof. The housing 170 may have a first position and a second position. The first position of the housing 170 may be vertical and the second position of the housing 170 may be non-vertical. In certain embodiments, the second position of the housing 170 may be horizontal.

Figure 29:
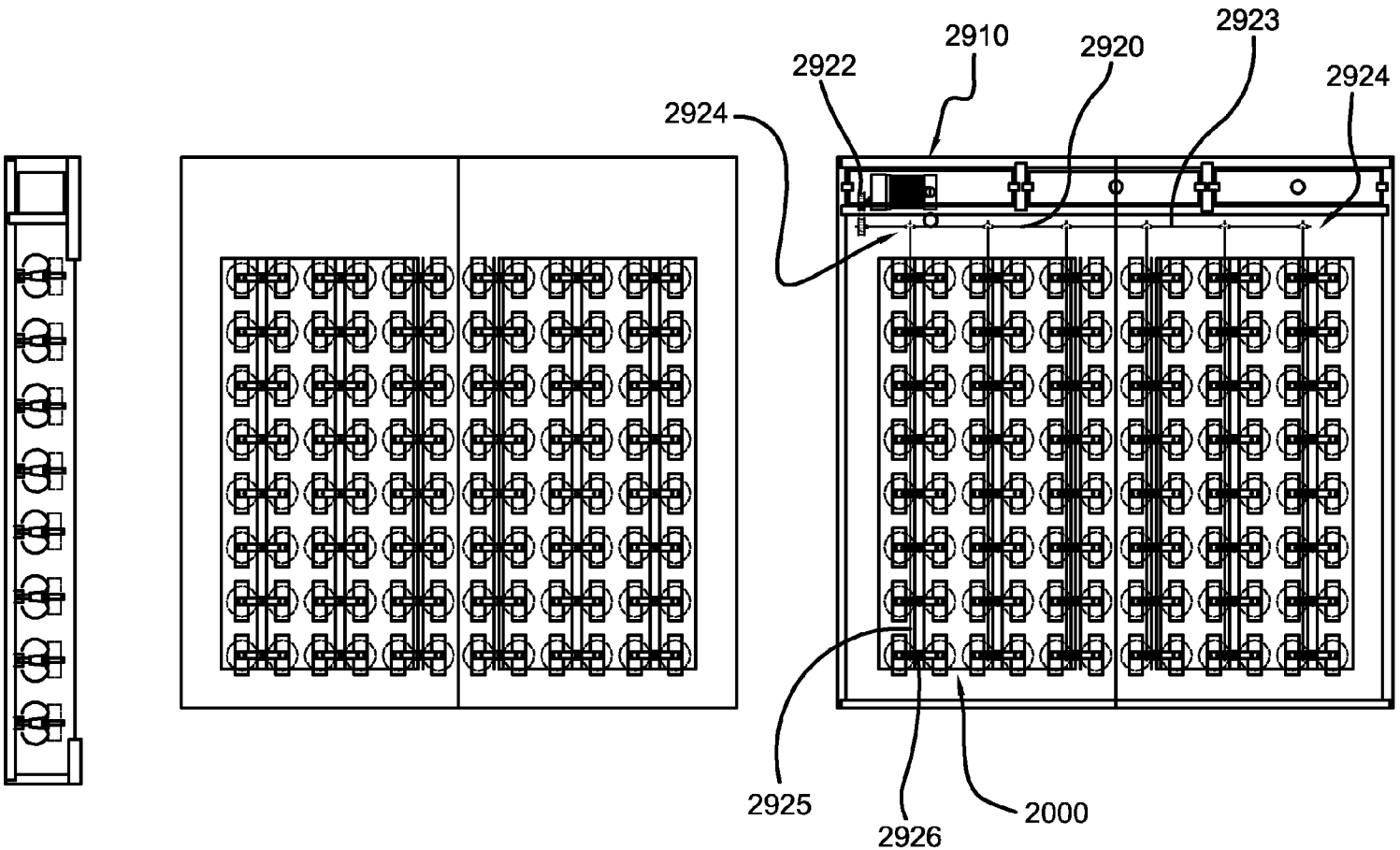
FIG. 29 shows an embodiment of an apparatus for storing a watch comprising a motor and a transmission.
Figure 30:
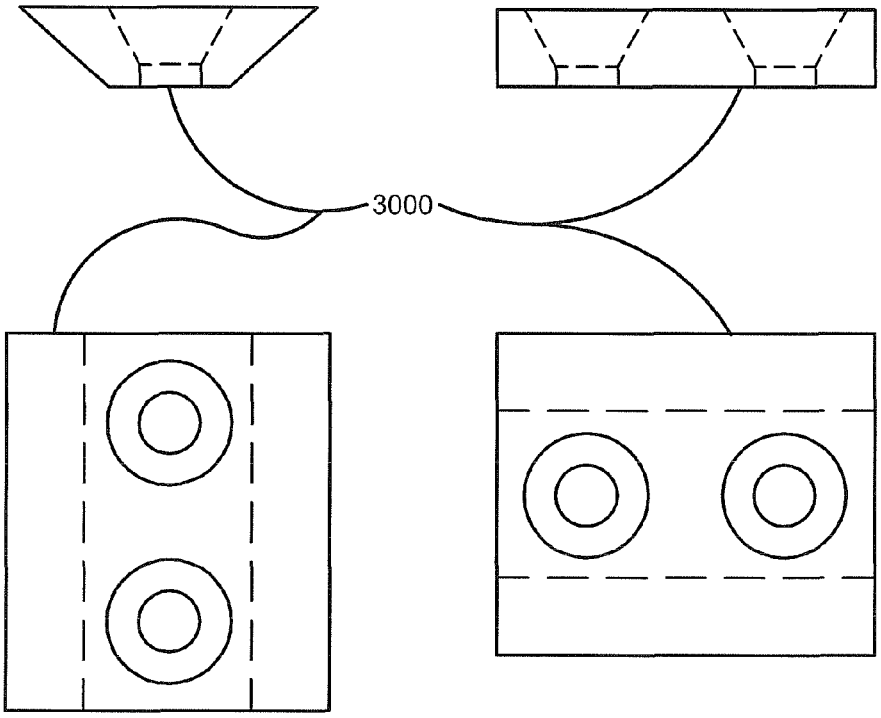
FIG. 30 shows an embodiment of a clamping block.
Figure 31:
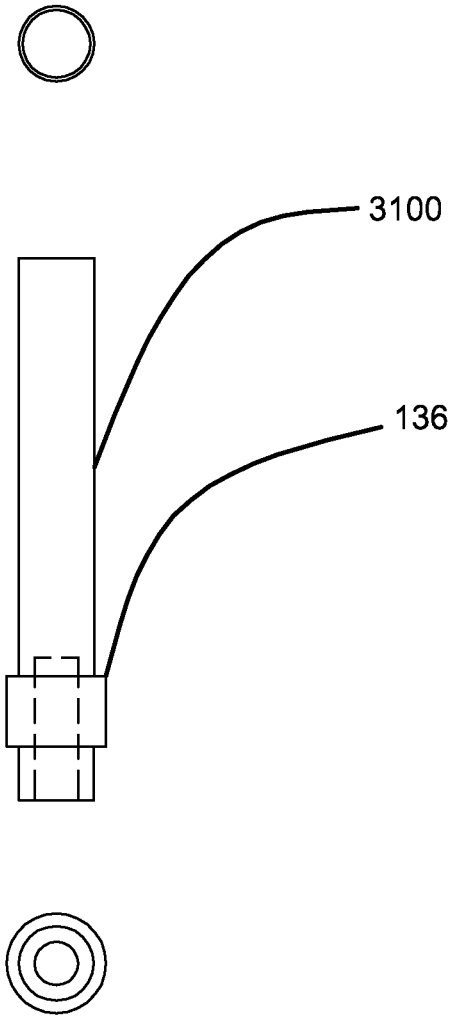
FIG. 31 shows an embodiment of a button.
Figure 32:
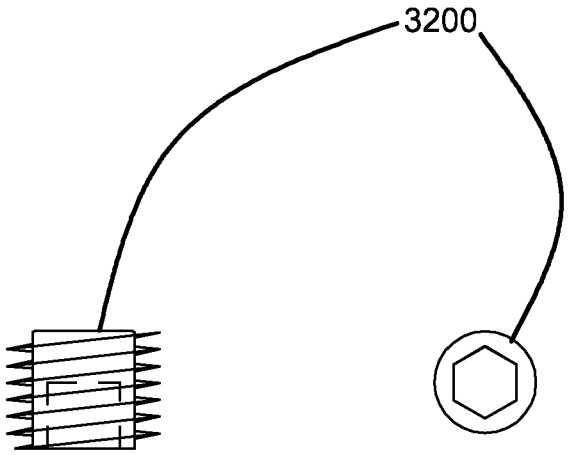
FIG. 32 shows an embodiment of a set screw.
Figure 33:
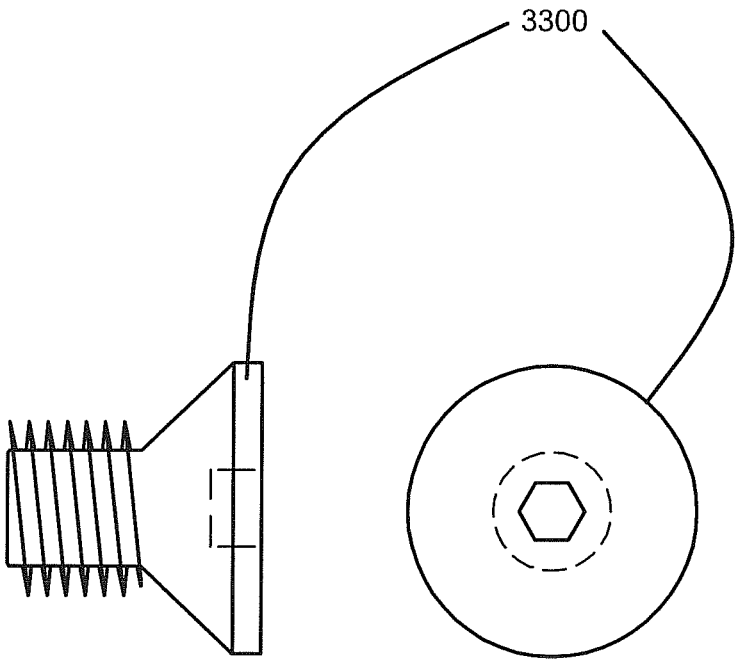
FIG. 33 shows an embodiment of a countersunk bolt.

The watch storage apparatus 100 may comprise a motor 2910 operationally engaged with the watch engagement mechanism 2000, 2100 and the base 2095, 2195. The motor 2910 may comprise an AC motor, a DC motor, a stepper motor, or a mechanical stored movement. The motor 2910 may be engaged with the watch engagement mechanism 2000, 2100 and the base 2095, 2195 to rotate the watch engagement mechanism 2000, 2100 with respect to the base 2095, 2195. The motor 2910 may be operationally engaged with a gearing 2920 or other transmission. In the embodiment shown in FIG. 29, the motor 2910 is operationally engaged with gearing 2920. Gearing 2920 comprises a primary transmission 2922 operationally engaged with motor 2910 to accept work therefrom and operationally engaged with a secondary output shaft 2923 to output work thereto. The primary transmission 2922 may comprise a gear and pinion, an epicyclical gearing, or other transmission elements. The secondary output shaft 2923 is operationally engaged with a tertiary output shaft 2925 to output work thereto. As shown in FIG. 29, the secondary output shaft 2923 is operationally engaged with each of six tertiary output shafts 2925 by means of a bevel gear set 2924 between each of the six tertiary output shafts 2925 and the secondary output shaft 2923 so as to transmit work therebetween. The tertiary output shaft 2925 is operationally engaged with a watch engagement mechanism 2000, 2100 to output work thereto. As shown in FIG. 29, each of the six tertiary output shaft 2925 is operationally engaged with each of six watch engagement mechanisms 2000, 2100 by means of a worm drive 2926 between each of the six watch engagement mechanism 2000, 2100 and the one of the six tertiary output shaft 2925 with which the watch engagement mechanism 2000, 2100 is engaged so as to transmit work therebetween.

Rotation of the watch engagement mechanism 2000, 2100 with respect to the base 2095, 2195 will also rotate, with respect to the base 2095, 2195, the retaining band 110, and associated watch A engaged, directly or indirectly, with the watch engagement mechanism 2000, 2100. Accordingly, associated watch A engaged with the watch storage apparatus 100 may be rotated by the motor (not shown). Rotating an associated watch A may be useful for purposes of winding the associated watch A. The motor may be engaged operationally engaged with the watch engagement mechanism 2000, 2100 and the base 2095, 2195 so as to provide rotation in a selectable direction, either clockwise or counterclockwise. The motor may be selectably engagable with one or more of a plurality of watch engagement mechanisms 2000, 2100 so as to permit an associated user to select which watch engagement mechanisms 2000, 2100 to rotate, and, thereby, which of any associated watches engaged thereto to rotate. The motor (not shown) may rotate at a user selectable speed. The user selectable speed may be selected from a set of discrete speeds or from a range of speeds. The user selectable speed may comprise speeds equal to or in excess of 800 revolutions per hour. The motor (not shown) may rotate for a user selectable duration. The user selectable duration may be selected from a set of discrete durations or from a range of durations. The user selectable duration may, without limitation, comprise a range of 1 to 5 hours. The motor (not shown) may be engaged with a control circuit (not shown) such as an electronic control. The control circuit (not shown) may be programmable to permit an associated user to provide detailed operational instructions regarding motor speed and direction as a function of time or revolutions. For example, in certain embodiments, a programmable control circuit allows a user to program a watch storage apparatus 100 to rotate selected individual watches at a rate of 800 revolutions per hour in the clockwise direction for one hour, to stop the motor and remain idle for ten minutes, and then to rotate selected individual watches at a rate of 800 revolutions per hour in the counterclockwise direction for 1600 revolutions.

In one embodiment a watch storage apparatus 100 may comprise an AC motor, an electronic control, and a gearing. The electronic control is operationally engaged with an electronic control adapted to control said AC motor. The gearing operationally engages the AC motor, directly or indirectly, with the watch engagement mechanism 2000, 2100.

In another embodiment a watch storage apparatus 100 may comprise a DC motor, an electronic control, and a gearing. The electronic control is operationally engaged with an electronic control adapted to control said DC motor. The gearing operationally engages the DC motor, directly or indirectly, with the watch engagement mechanism 2000, 2100.

In another embodiment a watch storage apparatus 100 may comprise a mechanical stored movement and a gearing. The mechanical stored movement may comprise mechanical elements to store work, such as, a spring or a flywheel. A mechanical stored movement may comprise mechanical computing or mechanical control elements such as a pendulum, a cam, a cam follower, an escapement, a Geneva mechanism, or other mechanical computing or mechanical control elements. The gearing operationally engages mechanical stored movement, directly or indirectly, with the watch engagement mechanism 2000, 2100.

Without limitation, a method for storing a watch may comprise, providing the watch storage apparatus 100, and securing the pin 130 into the hole of the receiver 140. Without limitation, a method for storing a watch may further comprise, mounting the watch storage apparatus 100 to a wall (not shown). Without limitation, the method for storing watch A may further comprise, releasing the pin 130 from the receiver 140, releasing watch A from the retaining band 110, and re-engaging the pin 130 and into the receiver 140.

Without limitation, a method for storing associated watch A may comprise, fastening the associated watch A by the wrist band B to the watch engagement mechanism 2000, 2100 comprising retaining band 110, and the pin 130; engaging watch engagement mechanism 2000, 2100 with the receiver 140; and engaging the receiver 140 with the base 2095, 2195.

Without limitation, a method for storing associated watch A may comprise, fastening associated watch A by the wrist band B to the watch storage apparatus 100, the watch storage apparatus 100 comprising the watch engagement mechanism 2000, 2100 comprising retaining band 110, the connector 120, and the pin 130; engaging watch engagement mechanism 2000, 2100 with the receiver 140; engaging the receiver 140 with the base 2095, 2195. The method for storing associated watch A may further comprise mounting the watch storage apparatus 100 to a wall. The method for storing a watch may further comprise releasing the watch engagement mechanism 2000, 2100 from the receiver 140; releasing the associated watch A from the retaining band 110; and re-engaging the watch engagement mechanism 2000, 2100 with the receiver.

While the apparatus and method for storing a watch has been described above in connection with the certain embodiments, it is to be understood that other embodiments may be used or modifications and additions may be made to the described embodiments for performing the same function of the apparatus and method for storing a watch without deviating therefrom. Further, the apparatus and method for storing a watch may include embodiments disclosed but not described in exacting detail. Further, all embodiments disclosed are not necessarily in the alternative, as various embodiments may be combined to provide the desired characteristics. Variations can be made by one having ordinary skill in the art without departing from the spirit and scope of the apparatus and method for storing a watch. Therefore, the apparatus and method for storing a watch should not be limited to any single embodiment, but rather construed in breadth and scope in accordance with the recitation of the attached claims.

What is claimed is:

1. A watch storage apparatus, comprising:

a base comprising a first surface and a receiver engaged with said first surface, said receiver comprising a first hole; and, a first watch engagement mechanism, comprising:

a pin, said pin selectively engagable with said first hole;

a retaining band engaged with said pin, said retaining band defining a structure having a perimeter to which an associated watch may be selectively removably and securely engaged about said perimeter so as to prevent slippage of the watch band relative to said perimeter of said structure;

a handle engaged with the pin, wherein said handle further comprises a first elongated portion oppositely disposed from a second elongated portion, wherein said retaining band is operatively connected to said first elongated portion; and a second retaining band operatively connected to said second elongated portion.

2. The watch storage apparatus of claim 1, wherein said retaining band comprises a flexible strap bent to define a substantially dimpled limaçon cross-section.

3. The watch storage apparatus of claim 2, wherein said substantially dimpled limaçon cross-section comprises, a gap; and a concavity.

4. The watch storage apparatus of claim 1, further comprising a housing enclosing said first watch engagement mechanism.

5. The watch storage apparatus of claim 1, further comprising a motor operationally engagable with said watch engagement mechanism, wherein said watch engagement mechanism is adapted to rotate relative to said base.

6. The watch storage apparatus of claim 1, further comprising a plurality of watch engagement mechanisms.

7. The watch storage apparatus of claim 1, wherein said base is adapted to be positioned on an associated wall.

8. The watch storage apparatus of claim 7, wherein the watch remains securely engaged to said perimeter of said structure upon positioning of said base on the wall.

9. A watch storage apparatus comprising:

a housing having a base comprising a first surface and a receiver engaged with said first surface, said receiver having a first hole, said housing having a first position and a second position; and, a plurality of watch engagement mechanisms, each mechanism having a pin, said pin selectively engagable with said first hole; and a first retaining band engaged with said pin, said first retaining band defining a structure having a perimeter to which an associated watch is selectively removably and securely engaged about said perimeter so as to prevent slippage of the watch relative to said perimeter of said structure, wherein said first retaining band is engaged with a cylindrical ball lock pin, said cylindrical ball lock pin being selectively engagable with said first hole; and said cylindrical ball lock pin comprising, a selectably releasable locking ball;

a spring; and a shaft, said shaft being movable by a user to selectably release the locking ball.

10. The watch storage apparatus of claim 9, further comprising:

a handle engaged with said pin, said handle having a first elongated portion oppositely disposed from a second elongated portion;

a second retaining band, wherein said first retaining band is operatively connected to said first elongated portion and said second retaining band is operatively connected to said second elongated portion, each of said first retaining band and said second retaining band having a flexible strap bent to define a substantially dimpled limaçon cross-section.

11. The watch storage apparatus of claim 10, wherein said first position of said housing is vertical and said second position of said housing is non-vertical.

12. A method of storing a watch, comprising the steps of:

providing a watch storage apparatus, the watch storage apparatus comprising:

a housing having a base comprising a first surface and a receiver engaged with said first surface, said receiver having a first hole; and, a watch engagement mechanism having a pin, a first retaining band operatively connected to said pin, said first retaining band defining a structure having a perimeter to which a first associated watch is selectively removably and securely engaged about said perimeter so as to prevent slippage of the watch relative to said perimeter of said structure;

a handle engaged with the pin, wherein said handle further comprises a first elongated portion oppositely disposed from a second elongated portion, wherein said first retaining band is operatively connected to said first elongated portion; and a second retaining band operatively connected to said second elongated portion;

securing the first watch to said first retaining band;

securing a second watch to said second retaining band;

securing said pin into the first hole of said receiver.

13. The method of claim 12, further comprising the step of:

mounting said watch storage apparatus to a wall.

14. The method of claim 12, further comprising the steps of:

releasing said pin from said receiver;

releasing the first watch from said first retaining band;

and re-engaging said pin into said receiver.

15. A watch storage apparatus comprising:

a base comprising a first surface, said base comprising horizontal surface engagement elements, or vertical surface engagement elements;

a receiver engaged with said first surface, said receiver comprising a cylindrical first hole, and a catch surface;

a cylindrical ball lock pin selectively engagable with said cylindrical first hole, said pin comprising, a selectably releasable locking ball, a spring, and a rod, said rod being movable by a user to selectably release the locking ball, said pin having a diameter defining a locational clearance fit with respect to said cylindrical first hole;

a handle engaged with said pin;

a retaining band selectively engagable with said pin, said retaining band defining a structure to which an associated watch band of an associated watch may be removably and securely engaged, said retaining band comprising a flexible strap bent to define a substantially dimpled limaçon cross-section, said substantially dimpled limaçon cross-section comprising, a gap, and a concavity;

a housing; and a motor operationally engagable with said pin and said base.

* * * * *